US011377319B2

(12) United States Patent
Kotani et al.

(10) Patent No.: US 11,377,319 B2
(45) Date of Patent: Jul. 5, 2022

(54) SHEET LOADING DEVICE, SHEET POST-PROCESSING DEVICE PROVIDED THEREWITH, AND IMAGE FORMING SYSTEM

(71) Applicant: KYOCERA Document Solutions Inc., Osaka (JP)

(72) Inventors: Takashi Kotani, Osaka (JP); Kazuhisa Iwamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 139 days.

(21) Appl. No.: 16/937,156

(22) Filed: Jul. 23, 2020

(65) Prior Publication Data

US 2021/0024316 A1 Jan. 28, 2021

(30) Foreign Application Priority Data

Jul. 26, 2019 (JP) ..... JP2019-138019

(51) Int. Cl.
*B65H 29/14* (2006.01)
*B65H 7/14* (2006.01)
(Continued)

(52) U.S. Cl.
CPC ..... *B65H 29/14* (2013.01); *B65H 7/14* (2013.01); *B65H 29/20* (2013.01); *B65H 29/40* (2013.01);
(Continued)

(58) Field of Classification Search
CPC ..... B65H 29/20; B65H 29/22; B65H 29/38; B65H 29/40; B65H 29/44; B65H 29/48;
(Continued)

(56) References Cited

U.S. PATENT DOCUMENTS 5,098,074 A * 3/1992 Mandel ..... B42C 1/12 270/58.13
2006/0145408 A1* 7/2006 Kotani ..... B65H 29/36 270/58.08
(Continued)

FOREIGN PATENT DOCUMENTS

JP 2008-7207 A 1/2008
JP 2013-82550 A 5/2013

*Primary Examiner* — Prasad V Gokhale
(74) *Attorney, Agent, or Firm* — Stein IP, LLC

(57) ABSTRACT

A sheet loading device includes a discharge roller pair, a loading tray, a paddle member, a sheet holding member, a tray lifting-lowering drive portion, a top surface detection sensor, and a control portion. The control portion is capable of performing a lifting-lowering operation to arrange the loading tray at a reference position by lowering the loading tray with the sheet holding member arranged at the holding position to turn the top surface detection sensor into an off state, then lifting the loading tray to turn the top surface detection sensor into an on state, and then lowering the loading tray again to turn the top surface detection sensor into the off state and stopping the loading tray. With the loading tray at the reference position, a predetermined clearance is provided between a top surface of a sheet loaded on the loading tray and a rotational orbit of the paddle member.

9 Claims, 15 Drawing Sheets

(51) Int. Cl.

| | |
|---|---|
| ***B65H 29/40*** | (2006.01) |
| ***B65H 29/48*** | (2006.01) |
| ***B65H 29/50*** | (2006.01) |
| ***B65H 29/20*** | (2006.01) |
| ***B65H 31/26*** | (2006.01) |
| ***B65H 43/08*** | (2006.01) |

(52) U.S. Cl.
CPC ..... *B65H 29/48* (2013.01); *B65H 29/50* (2013.01); *B65H 31/26* (2013.01); *B65H 43/08* (2013.01)

(58) Field of Classification Search
CPC ... B65H 7/02; B65H 7/04; B65H 7/14; B65H 31/04; B65H 31/08; B65H 31/10; B65H 31/26; B65H 43/02; B65H 43/08; B65H 2404/61; B65H 2404/612; B65H 2801/24; B65H 2801/27; B65H 29/14
See application file for complete search history.

(56) References Cited

U.S. PATENT DOCUMENTS

| | | | | |
|---|---|---|---|---|
| 2009/0039590 | A1* | 2/2009 | Yamashita | B65H 31/36 271/145 |
| 2017/0160690 | A1 | 6/2017 | Sato et al. | G03G 15/6541 |
| 2019/0225451 | A1* | 7/2019 | Kotani | B65H 37/04 |

* cited by examiner

SHEET LOADING DEVICE, SHEET POST-PROCESSING DEVICE PROVIDED THEREWITH, AND IMAGE FORMING SYSTEM

INCORPORATION BY REFERENCE

This application is based upon and claims the benefit of priority from the corresponding Japanese Patent Application No. 2019-138019 filed on Jul. 26, 2019, the entire contents of which are incorporated herein by reference.

BACKGROUND

The present disclosure relates to a sheet loading device on which a sheet such as a paper sheet is loaded after an image is formed thereon by an image forming apparatus such as a copier, a facsimile machine, a printer, or the like, a sheet post-processing device provided therewith, and an image forming system provided therewith.

Sheet post-processing devices have conventionally been used which are capable of stacking a plurality of sheets (paper sheets) on which images have been formed by an image forming apparatus such as a copier, a printer, or the like, and performing post-processing such as stapling processing of binding the stacked sheets as a sheet bundle with a staple, punching processing of forming a hole (punched hole) using a punching device, etc.

Such conventional sheet post-processing devices each include a sheet loading device having a discharge roller pair which discharges a sheet having undergone post-processing and a loading tray on which the sheet discharged by the discharge roller pair is loaded. A known example of a sheet loading device includes a paddle member which slaps an upstream part (a rear end part) of a sheet in a discharge direction after the sheet passes through a nip portion of a discharge roller pair, and thereby makes the sheet fall onto the loading tray.

For example, a sheet discharge device is known which is provided with a holding member rotatable about a rotation shaft arranged below a rotation shaft of a sheet discharge roller (a discharge roller pair). The holding member and the sheet discharge roller are respectively driven to rotate by a holding-member drive motor and a sheet-discharge drive motor, which are separate from each other. The holding member is caused to rotate by a driving force received from the holding-member drive motor, and thereby holds a rear end part of a sheet in a sheet discharge direction as if by slapping the rear end part from above.

Another sheet discharge device is known which is provided with a scraping member; the scraping member is arranged coaxial with a driven discharge roller of a discharge rotary body pair (a discharge roller pair), and is driven to rotate by a sheet discharged by the discharge rotary body pair. The scraping member has a plurality of flexible blade members projecting from its outer peripheral surface. The blade members scrape a rear end part of a sheet having passed through the discharge rotary body pair, and further hold down the rear end part of the sheet loaded on a loading tray.

SUMMARY

According to an aspect of the present disclosure, a sheet loading device includes a discharge roller pair, a loading tray, a paddle member, a sheet holding member, a tray lifting-lowering drive portion, a top surface detection sensor, and a control portion. The discharge roller pair includes a drive roller and a driven roller which follows the drive roller to rotate, and discharges a sheet. The loading tray is arranged on a downstream side of the discharge roller pair with respect to a discharge direction of the sheet, and the sheet discharged by the discharge roller pair is loaded on the loading tray. The paddle member is arranged coaxial with the drive roller, and rotates in a same direction as the drive roller to thereby come into contact, from above, with an upstream part, in the discharge direction, of the sheet discharged by the discharge roller pair. The sheet holding member is arranged below the discharge roller pair, and is swingable between a holding position at which the sheet holding member holds the upstream part of the sheet in the discharge direction loaded on the loading tray and a retraction position at which the sheet holding member releases holding of the sheet. The tray lifting-lowering drive portion lifts and lowers the loading tray. The top surface detection sensor switches between an on state in which the top surface detection sensor performs detection of a sheet loading surface of the loading tray or of a top surface of the sheet loaded on the sheet loading surface and an off state in which the top surface detection sensor does not perform the detection. The control portion controls the tray lifting-lowering drive portion. The control portion is capable of performing a lifting-lowering operation to arrange the loading tray at a reference position by lowering the loading tray with the sheet holding member arranged at the holding position to turn the top surface detection sensor into the off state, then lifting the loading tray to turn the top surface detection sensor into the on state, and then lowering the loading tray again to turn the top surface detection sensor into the off state and stop the loading tray. With the loading tray at the reference position, a predetermined clearance is provided between the top surface of the sheet loaded on the loading tray and a rotational orbit of the paddle member.

Still other objects of the present disclosure and specific advantages provided by the present disclosure will be made further apparent from the following description of an embodiment.

BRIEF DESCRIPTION OF THE DRAWINGS

FIG. 15 is a side sectional view of the sheet loading device, showing a state in which the top surface detection sensor is on.

FIG. 17 is a side sectional view of the sheet loading device where the top surface detection sensor is arranged at the position overlapping with the leading end of the sheet holding member arranged at the holding position, showing a state in which the upper surface sensor is on.

DETAILED DESCRIPTION

Figure 1:
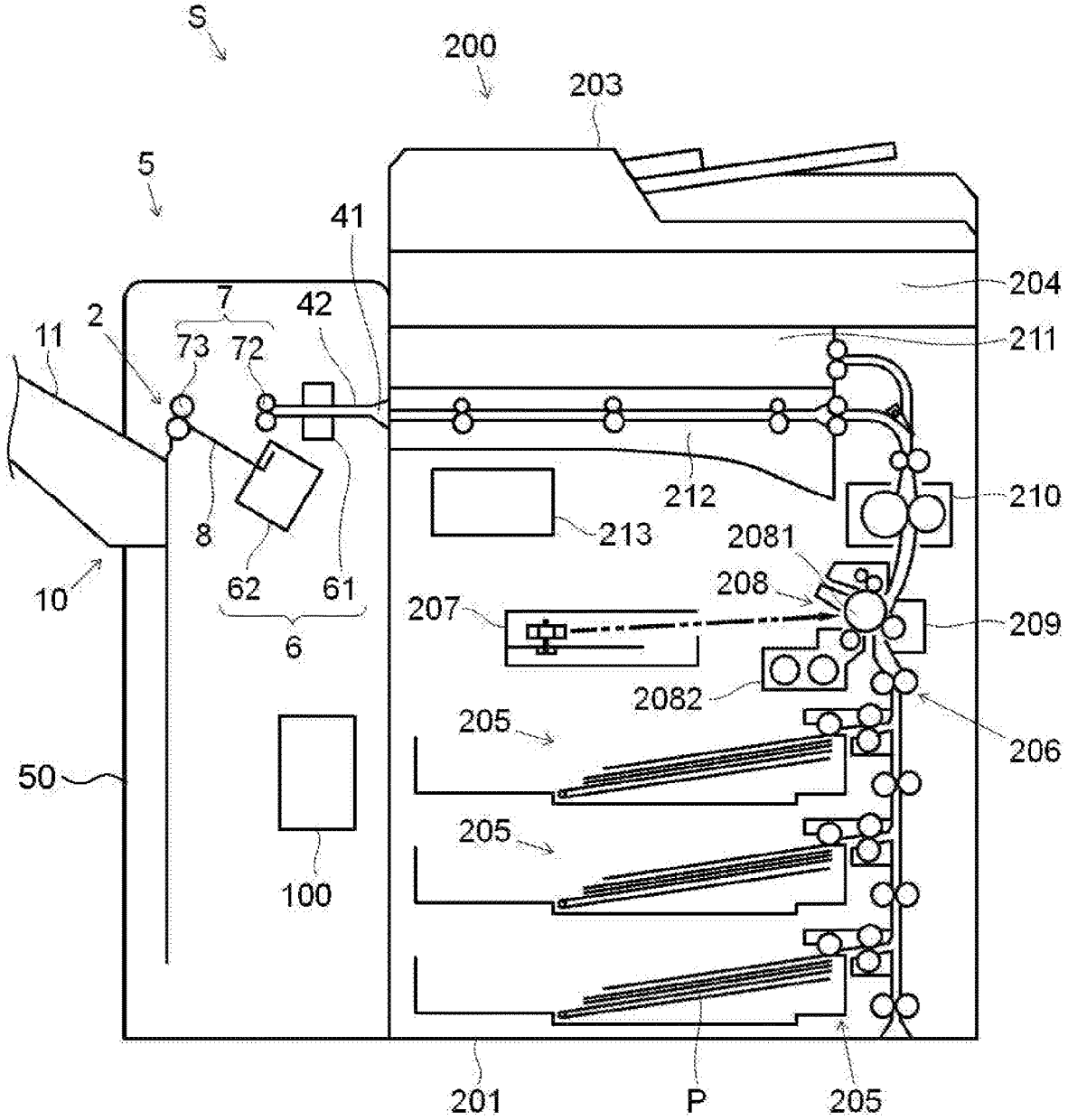
FIG. 1 is a schematic diagram of an image forming system including an image forming apparatus and a sheet post-processing device according to an embodiment of the present disclosure.

Hereinafter, an embodiment of the present disclosure will be described with reference to the accompanying drawings, FIG. 1 is a schematic diagram of an image forming system S which includes an image forming apparatus 200 and a sheet post-processing device 5 according to an embodiment of the present disclosure. The image forming system S includes the image forming apparatus 200 and the sheet post-processing device 5.

The image forming apparatus 200 is what is called a monochrome multifunction peripheral having functions of, for example, printing (print), scanning (image reading), and facsimile transmission. In the image forming apparatus 200, as shown in FIG. 1, a document transport portion 203 is placed on atop surface of a main body portion 201. At a position that is below the document transport portion 203 but is inside the main body portion 201, an image reading portion 204 is provided. The image reading portion 204 reads an image on a document loaded on the document transport portion 203 or an image on a document placed on an unillustrated contact glass provided on a top surface of the image reading portion 204.

The image forming apparatus 200 further includes a sheet feeding portion 205, a sheet transport portion 206, an exposure portion 207, an image forming portion 208, a transfer portion 209, a fixing portion 210, a sheet discharge portion 211, a relay portion 212, and a main body control portion 213.

The sheet feeding portion 205 holds a plurality of sheets P, and feeds them out one by one, separately from each other, during printing. The sheet transport portion 206 transports a sheet P fed out from the sheet feeding portion 205 to the transfer portion 209 and the fixing portion 210, and further transports the sheet P having undergone fixing to the sheet discharge portion 211 or to the relay portion 212. The exposure portion 207 emits laser light controlled based on image data toward the image forming portion 208.

The image forming portion 208 includes a photosensitive drum 2081 as an image carrier and a development device 2082. In the image forming portion 208, the laser light emitted from the exposure portion 207 forms, on a surface of the photosensitive drum 2081, an electrostatic latent image based on a document image. The development device 2082 supplies toner to the electrostatic latent image to develop it into a toner image. The transfer portion 209 transfers, onto a sheet P, the toner image formed by the image forming portion 208 on the surface of the photosensitive drum 2081. The fixing portion 210 applies heat and pressure to the sheet P having the toner image transferred thereon to fix the toner image on the sheet P.

After the fixing, the sheet P is transported to the sheet discharge portion 211 or to the relay portion 212. The sheet discharge portion 211 is arranged below the image reading portion 204. The sheet discharge portion 211 has an opening in its front face, and the sheet P after the printing (a printed sheet) is taken out from the front-face side. The relay portion 212 is arranged below the sheet discharge portion 211. The relay portion 212 has its downstream end in a sheet transport direction connected to the sheet post-processing device 5. The sheet P (printed matter) after the printing having been sent to the relay portion 212 passes through the relay portion 212 to be transported into the sheet post-processing device 5.

The main body control portion 213 includes a CPU, an image processing portion, and a storage portion, of which none is illustrated, and other unillustrated electronic circuits and components. The CPU, based on a control program and control data stored in the storage portion, controls operations of various constituent elements provided in the image forming apparatus 200 to perform processing related to functions of the image forming apparatus 200. The sheet feeding portion 205, the sheet transport portion 206, the exposure portion 207, the image forming portion 208, the transfer portion 209, and the fixing portion 210 each individually receive an instruction from the main body control portion 213, and coordinate with each other to perform printing with respect to the sheet P. The storage portion is configured as a combination of non-volatile storage devices such as a program ROM (Read Only Memory) and a data ROM and a volatile storage device such as a RAM (Random Access Memory).

The sheet post-processing device 5 is attachably and detachably connected to a side face of the image forming apparatus 200. The sheet post-processing device 5 includes a post-processing housing 50, and a post-processing mechanism 6, a sheet transport mechanism 7, a processing tray 8, a sheet loading device 10, and a post-processing control portion 100, which are arranged inside the post-processing housing 50.

In such a side face of the post-processing housing 50 as faces the image forming apparatus 200, a sheet receiving port 41 is provided. After passing through the relay portion 212, the sheet P passes through the sheet receiving port 41 to be transported into the sheet post-processing device 5.

A sheet transport path 42 extends from the sheet receiving port 41, in a direction away from the image forming apparatus 200 (leftward in FIG. 1), to a position above the processing tray 8.

The post-processing mechanism 6 performs predetermined post-processing with respect to the sheet P transported along the sheet transport path 42. The post-processing mechanism 6 includes a punching processing portion 61 and a staple processing portion 62.

The punching processing portion 61 is arranged at an intermediate position between the sheet receiving port 41, which is an upstream end of the sheet transport path 42 in the sheet transport direction (an arrow-H11 direction in FIG. 2), and a downstream end of the sheet transport path 42. The punching processing portion 61 performs punching processing with respect to the sheet P transported along the sheet transport path 42 to form a punched hole (a binding hole) in the sheet P. Here, the punched hole is formed along one of opposite edges of the sheet P in its width direction which is perpendicular to the sheet transport direction.

The staple processing portion 62 is arranged at a position that is below the sheet transport path 42 but is on an upstream side of the processing tray 8 in the sheet transport direction. The sheet post-processing device 5, by using the staple processing portion 62, can perform staple processing (binding processing) of binding a bundle of sheets P (hereinafter referred to simply as "sheet bundle") placed on the processing tray 8 with a staple needle to bind the sheet bundle. Here, what is called edge binding processing is performed, in which a sheet bundle is bound with a staple needle at a corner or at an edge.

The sheet transport mechanism 7 transports the sheet P in the sheet transport direction which is along the sheet transport path 42. The sheet transport mechanism 7 has a transport roller pair 71 (see FIG. 2), an intermediate roller pair 72, and a discharge roller pair 73, which are arranged in this order from an upstream side in the sheet transport direction.

The processing tray 8 is arranged below a downstream part of the sheet transport path 42 in a sheet discharge direction. In other words, the processing tray 8 is located at a position that is on a downstream side of the intermediate roller pair 72 in the sheet discharge direction but is below the intermediate roller pair 72. A plurality of sheets P having passed through the sheet transport path 42 to reach the processing tray 8 are placed on the processing tray 8, where the staple processing is performed on them by the staple processing portion 62.

The sheet loading device 10 has a loading tray 11 arranged on a downstream side of the processing tray 8 in the sheet discharge direction to be adjacent to the processing tray 8. The sheet bundle, with respect to which the staple processing has been completed on the processing tray 8, is discharged by the discharge roller pair 73 to be loaded on the loading tray 11. Here, in a case where the staple processing portion 62 does not perform the staple processing, the sheets P are transported to the loading tray 11 without being loaded on the processing tray 8. A detailed configuration of the sheet loading device 10 will be described later.

The post-processing control portion 100 includes a CPU and a storage portion, of which neither is illustrated, and other unillustrated electronic circuits and components. The post-processing control portion 100 is communicably connected to the main body control portion 213. The post-processing control portion 100 receives an instruction from the main body control portion 213, and, by using the CPU, based on a control program and control data stored in the storage portion, controls operations of various constituent elements provided in the sheet post-processing device 5 to perform processing related to functions of the sheet post-processing device 5. The post-processing mechanism 6, the sheet transport mechanism 7, the processing tray 8, and the sheet loading device 10 each individually receive an instruction from the post-processing control portion 100, and coordinate with each other to perform the post-processing with respect to the sheet P. The storage portion is configured as a combination of storage devices such as a program ROM, a data ROM, a RAM, etc., of which none is illustrated. A detailed control path in the post-processing control portion 100 will be described later.

Figure 2:
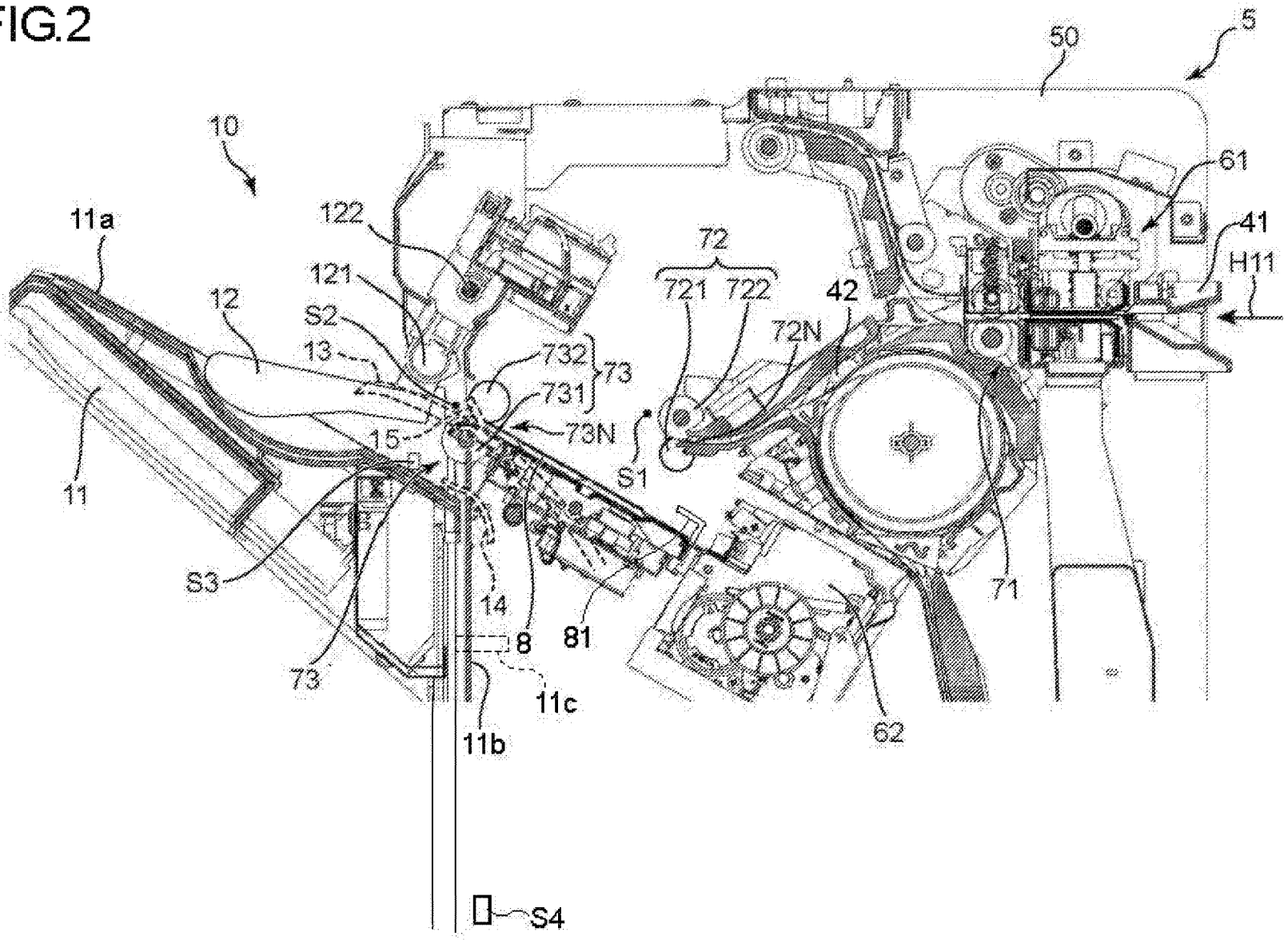
FIG. 2 is a side sectional view showing an internal structure of the sheet post-processing device of the present embodiment.
Figure 3:
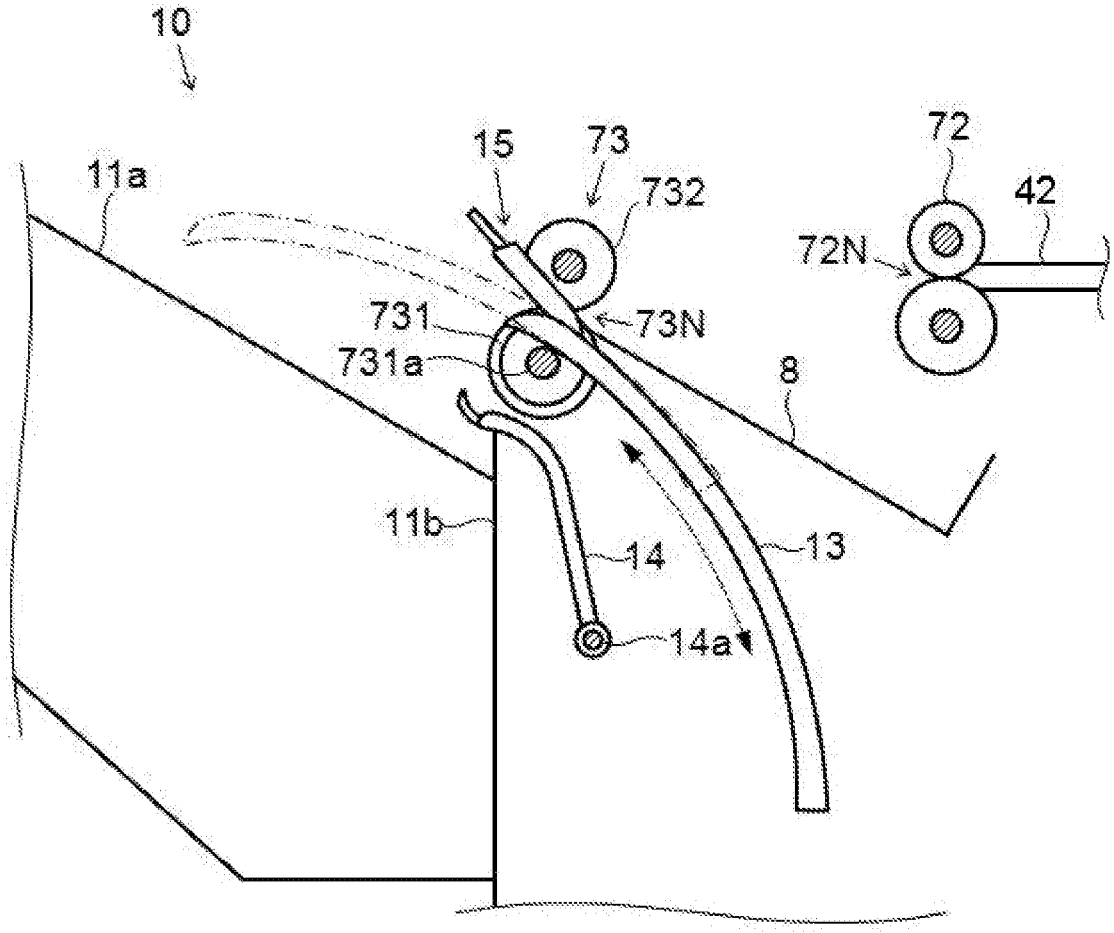
FIG. 3 is an enlarged sectional view of and around a processing tray shown in FIG. 2.

FIG. 2 is a side sectional view showing an internal structure of the sheet post-processing device 5. FIG. 3 is a side sectional view showing a structure of and around the processing tray 8 shown in FIG. 2. The transport roller pair 71 is arranged on a downstream side of the punching processing portion 61 in the sheet transport direction (the arrow-H11 direction) to be adjacent to the punching processing portion 61. The transport roller pair 71 transports a sheet that has undergone the punching processing or a sheet that has not undergone the punching processing to a downstream side in the sheet transport direction H11.

The intermediate roller pair 72 is arranged, on the sheet transport path 42, at a position between an upstream-side end part and a downstream-side end part of the sheet transport path 42 in the sheet transport direction. The intermediate roller pair 72 includes a first drive roller 721 which rotates on receiving a driving force from a transport drive portion 70 (see FIG. 12), and a first driven roller 722 which follows the first drive roller 721 to rotate. The first drive roller 721 and the first driven roller 722 are in contact with each other under a predetermined nip pressure therebetween to form a first nip portion 72N which nips and transports a sheet.

Immediately near the intermediate roller pair 72 on its downstream side, a first sheet detection portion S1 is arranged. The first sheet detection portion S1 is a sensor which optically detects a sheet, and detects that a leading end of a sheet transported by the transport roller pair 71 has entered into the intermediate roller pair 72. The first sheet detection portion S1 also detects that the sheet transported by the intermediate roller pair 72 has passed through the intermediate roller pair 72.

The discharge roller pair 73 is arranged on a downstream side of the sheet transport path 42 in the sheet transport direction. The discharge roller pair 73 includes a second drive roller 731 which rotates on receiving a driving force from a discharge drive portion 90 (see FIG. 12), and a second driven roller 732 which follows the second drive roller 731 to rotate. The second drive roller 731 and the second driven roller 732 are in contact with each other under a predetermined nip pressure therebetween to form a second nip portion 73N which nips and transports a sheet. The second nip portion 73N is released by a nip release mechanism 74 (see FIG. 12) when the staple processing portion 62 performs the staple processing.

Immediately near the discharge roller pair 73 on its downstream side, a second sheet detection portion S2 is arranged. The second sheet detection portion S2 includes an actuator and a photosensor; the actuator has a contact piece, which a sheet discharged by the discharge roller pair 73 comes into contact with, and a detection piece, and the photosensor has a light emitter and a light receiver which are arranged facing each other with the detection piece located therebetween. When the leading end of a sheet transported by the intermediate roller pair 72 comes into contact with the contact piece, the actuator rotationally moves in a clockwise direction, so that the detection piece moves out of an optical path extending from the light emitter to the light receiver. Thereby, it is detected that a leading end of the sheet has entered the discharge roller pair 73 and that the sheet is being discharged by the discharge roller pair 73. On the other hand, when a rear end of the sheet passes by the contact piece, the actuator rotationally moves in a counterclockwise direction, so that the detection piece moves into the optical path extending from the light emitter to the light receiver. Thereby, it is detected that the rear end of the sheet has passed through the discharge roller pair 73.

Below the sheet transport path 42, the processing tray 8 is arranged. The processing tray 8, with the second nip portion 73N of the discharge roller pair 73 released, receives the sheet transported by the intermediate roller pair 72 to have the sheet loaded thereon. A sheet bundle loaded on the processing tray 8 is subjected to the staple processing performed by the staple processing portion 62. The processing tray 8, having its downstream-side end part (left end part in FIG. 2) in the sheet transport direction located near the discharge roller pair 73 and its upstream-side end part (right end part in FIG. 2) located below the intermediate roller pair 72, is inclined downward from its downstream-side end part toward its upstream-side end part in the sheet transport direction.

The processing tray 8 is provided with a bundle discharge member 81 which supports an upstream-side end part (a rear end) of a sheet bundle. The bundle discharge member 81 is fixed to a drive belt (not shown) arranged on a rear-surface side of the processing tray 8, and part of the bundle discharge member 81 projects from a placing surface of the processing tray 8 in an L-shape in side view. Along with the drive belt being rotationally moved by the discharge drive portion 90 (see FIG. 12), the bundle discharge member 81 reciprocates along the placing surface of the processing tray 8 in the sheet transport direction.

A sheet bundle loaded on the processing tray 8 and having been subjected to the staple processing by the staple processing portion 62 is discharged to the sheet loading device 10 by the discharge roller pair 73 with the second nip portion 73N recovered or by the bundle discharge member 81.

The sheet loading device 10 has loaded thereon sheets having been subjected to the post-processing by the post-processing mechanism 6. The sheet loading device 10 includes the loading tray 11, a pair of cursor members 12, a projection member 13, a sheet holding member 14, and a paddle member 15.

The loading tray 11 is arranged on a downstream side of the discharge roller pair 73 with respect to the sheet transport direction (hereinafter may also be referred to as the sheet discharge direction), and is a final destination to which a sheet is discharged in the sheet post-processing device 5. The loading tray 11 has a sheet loading surface 11*a* on which are loaded sheets discharged by the discharge roller pair 73 or by the bundle discharge member 81, such as sheets having been subjected to the punching processing by the punching processing portion 61, a sheet bundle having been subjected to the staple processing by the staple processing portion 62, etc. The sheet loading surface 11*a* is highest at its downstream-end part in the sheet discharge direction, and is inclined downward toward its upstream-side end part.

The upstream-side end part of the sheet loading surface 11*a* is located below the discharge roller pair 73. Immediately near the sheet loading surface 11*a* on its upstream side, a sheet receiving wall 11*b* is provided upright. The sheet receiving wall 11*b* receives the upstream-side end part (the rear end) of a sheet that comes sliding down the sheet loading surface 11*a*.

The loading tray 11 is configured to be able to be lifted and lowered by a tray lifting-lowering drive portion 113 (see FIG. 12) in accordance with an amount of sheets loaded on the sheet loading surface 11*a*. At a position that is slightly downstream of the upstream-side end part of the loading tray 11, a top surface detection sensor S3 is arranged. The top surface detection sensor S3 is a photosensor that detects the sheet loading surface 11*a* or a top surface of a sheet loaded on the sheet loading surface 11*a*. In accordance with a detection signal of the top surface detection sensor S3, an operation of lifting-lowering (positioning) the loading tray 11 performed by the tray lifting-lowering drive portion 113 is controlled. The operation of lifting-lowering the loading tray 11 is performed once for every predetermined number of sheets (for example, every 10 sheets) or at predetermined time intervals (for example, every several seconds). Thereby, a position of a topmost surface of sheets on the sheet loading surface 11*a* is maintained at a constant height.

In a lower part of the post-processing housing 50, a lower limit detection sensor S4 is provided which detects a lower limit position of the loading tray 11. The lower limit detection sensor S4 is a photosensor similar to the top surface detection sensor S3, and can detect, when an optical path of a detection portion is blocked by a flag 11*e* provided on and projecting from the loading tray 11, that the loading tray 11 has descended to the lower limit position. Here, as the top surface detection sensor S3 and the lower limit detection sensor S4, other sensors may be used instead of photosensors. Details of the operation of lifting-lowering the loading tray 11 will be described later.

The pair of cursor members 12 are supported by a holder 121 through which a shaft 122 is inserted. The shaft 122 is supported by the post-processing housing 50 so as to extend along a sheet width direction above the discharge roller pair 73. The holder 121 is supported by the shaft 122 so as to be movable along the sheet width direction. The holder 121 supports the pair of cursor members 12 such that leading end parts of the pair of cursor members 12 are swingable in an up-down direction.

The projection member 13 is a rod-shaped member having a predetermined width in the sheet width direction and extending in the sheet discharge direction in an are shape, and is arranged below a sheet discharge port 2. In detail, the projection member 13 is arranged below the processing tray 8 so as to be below a discharge path via which a sheet is discharged from the discharge roller pair 73 along the processing tray 8. In the present embodiment, the projection member 13 is arranged, for example, at each of two positions in the sheet width direction, the two positions each being at a predetermined distance from a center part of the loading tray 11 in the sheet width direction. Here, the projection members 13 are arranged at positions different from the position of the paddle member 15 with respect to the sheet width direction.

Figure 4:
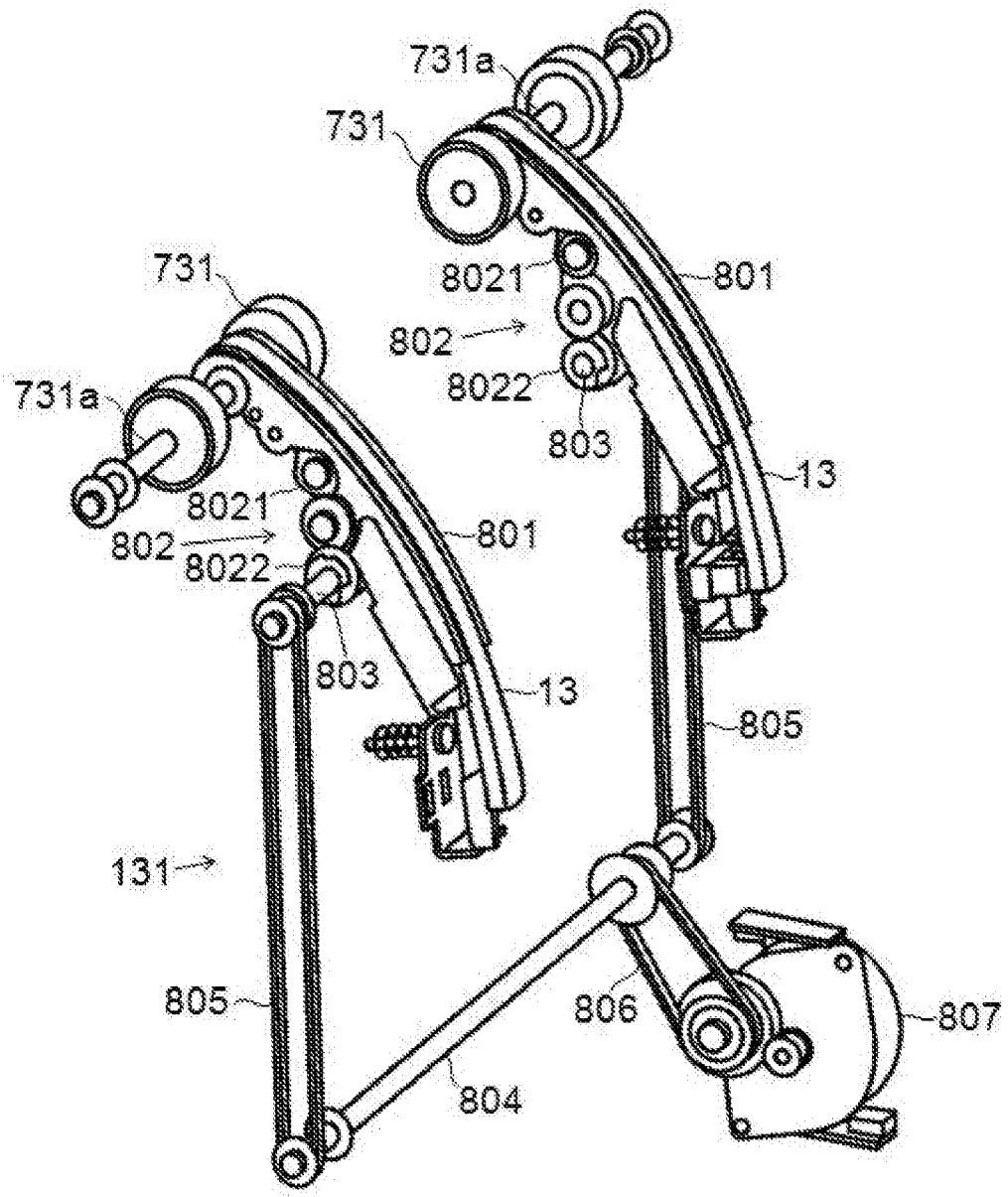
FIG. 4 is a perspective view showing a structure of a projection drive portion in a sheet loading device of the present embodiment, showing a state in which a projection member is located at a retraction position.
Figure 5:
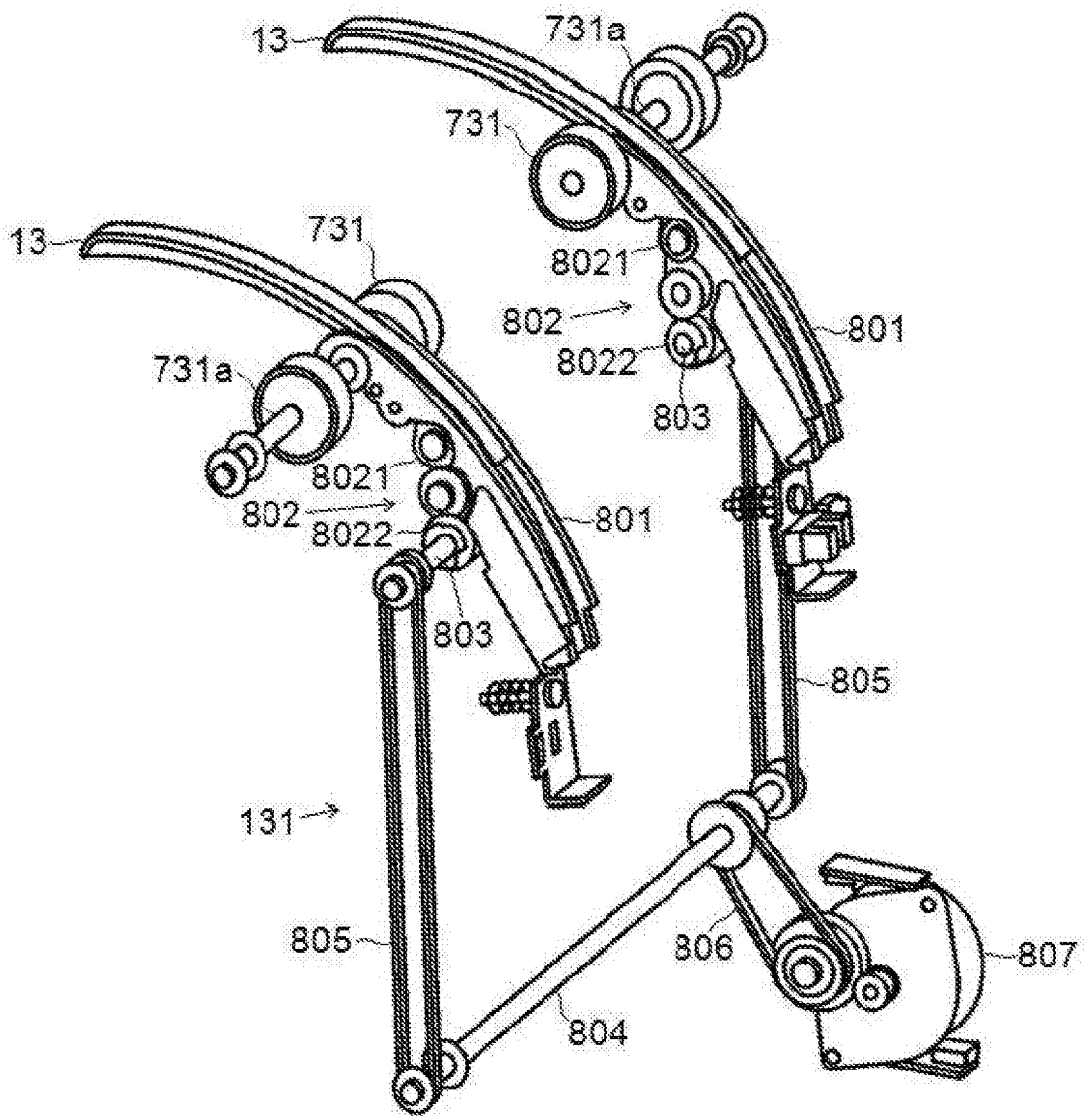
FIG. 5 is a perspective view showing the structure of the projection drive portion in the sheet loading device of the present embodiment, showing a state in which the projection member is located at a projection position.

The projection member 13 is supported by a projection drive portion 131 shown in FIGS. 4 and 5, and displaced by the projection drive portion 131 along the sheet discharge direction. The projection drive portion 131 includes a guide rail 801, a drive transmission gear group 802, a drive transmission shaft 803, a drive shaft 804, a drive transmission belt 805, a drive belt 806, and a drive motor 807.

Two guide rails 801, two drive transmission gear groups 802, two drive transmission shafts 803, and two drive transmission belts 805 are provided corresponding to the two projection members 13. One drive shaft 804, one drive belt 806, and one drive motor 807 are provided.

The guide rail 801 is arranged on an upstream side of the discharge roller pair 73 in the sheet discharge direction. The guide rail 801 is an open-topped gutter-shaped member, extending in an arc shape in the sheet discharge direction like the projection member 13. The guide rail 801 accommodates and supports the projection member 13 inside thereof.

The drive transmission gear group 802 is arranged below the guide rail 801. The drive transmission gear group 802 is composed of a plurality of gears in mesh with each other, and includes a pinion gear 8021 at an end on a side of the guide rail 801, and a drive transmission gear 8022 at an end on a side of the drive transmission shaft 803.

The pinion gear 8021 is arranged directly under the guide rail 801. On a lower-face side of the projection member 13, there is formed a rack (not shown) of a rack-and-pinion gear mechanism. The rack has a plurality of teeth aligned along the sheet discharge direction. The pinion gear 8021 meshes with the rack of the projection member 13. Here, in the guide rail 801, at a position adjacent to the pinion gear 8021, there is provided an unillustrated window portion via which the pinion gear 8021 and the projection member 13 mesh with each other.

The drive transmission shaft 803 is arranged in a lower part of the drive transmission gear group 802. The drive transmission shaft 803 extends along the sheet width direction. The drive transmission gear 8022 of the drive transmission gear group 802 is arranged coaxially with the drive transmission shaft 803, and rotates together with the drive transmission shaft 803.

The drive shaft 804 is arranged below the drive transmission shaft 803. The drive shaft 804 extends along the sheet width direction.

The drive transmission belt 805 is wound around the drive transmission shaft 803 and the drive shaft 804 via pulleys. In detail, the two drive transmission belts 805 are wound around the one drive shaft 804, and are respectively wound around the separate drive transmission shafts 803. The drive transmission belts 805 transmits a rotational force of the drive shaft 804 to the drive transmission shafts 803.

The drive belt 806 is wound around the drive shaft 804 and a rotation shaft of the drive motor 807 via pulleys. The drive belt 806 is rotated by the drive motor 807.

In the projection drive portion 131, when the drive motor 807 rotates, a rotational force of the drive motor 807 is transmitted via the drive belt 806 to the drive shaft 804, so that the drive shaft 804 rotates. When the drive shaft 804 rotates, the rotational force is transmitted via the drive transmission belt 805 to the drive transmission shaft 803. When the drive transmission shaft 803 rotates, the rotational force is transmitted via the drive transmission gear group 802 to the pinion gear 8021. Thereby, the two projection members 13 are simultaneously displaced along the sheet discharge direction. The displacement of the projection members 13, in other words, the operation of the projection drive portion 131, is controlled by the post-processing control portion 100.

Referring back to FIG. 3, the sheet holding member 14 is arranged on an upstream side of the loading tray 11 in the sheet discharge direction. The sheet holding member 14 is arranged below a rotation shaft 731*a* of the second drive roller 731 of the discharge roller pair 73. In the present embodiment, as the sheet holding member 14, for example, two sheet holding members 14 are arranged to be spaced from each other by a predetermined distance on the loading tray 11 in the sheet width direction. Here, the sheet holding members 14 are arranged at positions different from the position of the paddle member 15 with respect to the sheet width direction.

The sheet holding member 14 is a rod-shaped member having a predetermined width in the sheet width direction and extending substantially in the up-down direction. The sheet holding member 14 is, at its lower end part, swingably supported about a swing shaft 14*a* which extends along the sheet width direction as a swing fulcrum. The sheet holding member 14 is caused by a sheet holding drive portion 142 (see FIG. 12) to swing about the swing shaft 14*a* in the sheet discharge direction, with its upper end part as a free end. The sheet holding member 14 is displaced between a holding position (see FIG. 14) for holding the upstream part of a sheet loaded on the loading tray 11 in the sheet discharge direction and a retraction position (see FIG. 3) for releasing the holding of the sheet.

The sheet holding member 14 is, as shown in FIG. 3, before a sheet discharging operation is started, stationary at the retraction position where it does not project toward the loading tray 11. In this manner, the sheet holding member 14, when out of use, does not interfere with discharging of a sheet.

Figure 14:
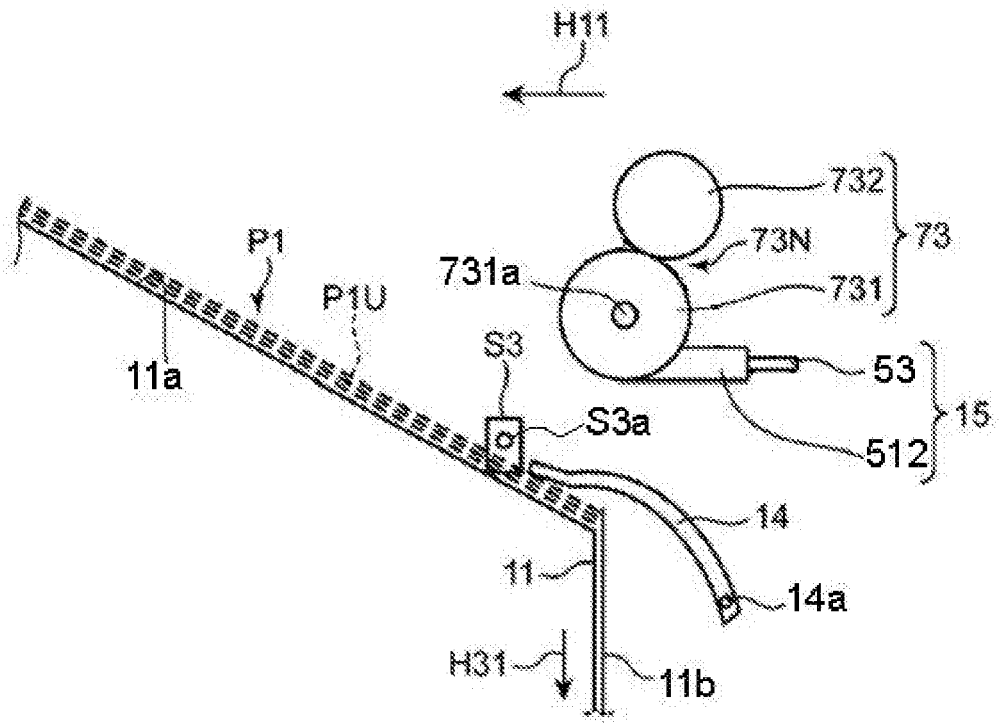
FIG. 14 is a side sectional view of the sheet loading device, showing a state in which a top surface detection sensor is off.

Subsequently, the paddle member 15 is rotated, and, before the paddle member 15 passes an upstream end of the loading tray 11 in the sheet discharge direction, swinging of the sheet holding member 14 is started. Then, the sheet holding member 14 is, as shown in FIG. 14, displaced to the sheet-holding position where it holds the upstream part of a sheet loaded on the loading tray 11 in the sheet discharge direction.

According to this configuration, it is possible to hold a rear end of a curled sheet from above by means of the sheet holding member 14. Thereby, even a case where the discharging and the loading of sheets with respect to the loading tray 11 are performed at high speed can be handled, so that the upstream part of a sheet loaded on the loading tray 11 in the sheet discharge direction can be held from above, and sheets on the loading tray 11 can be aligned preferably.

The paddle member 15 is arranged coaxially with the discharge roller pair 73. In detail, the paddle member 15 is arranged coaxially with the rotation shaft 731*a* of the second drive roller 731 extending along the sheet width direction. More in detail, in the present embodiment, two paddle members 15 are provided coaxially with the rotation shaft 731*a* of each of the two second drive rollers 731, such that a total of four paddle members 15 are provided.

Figure 6:
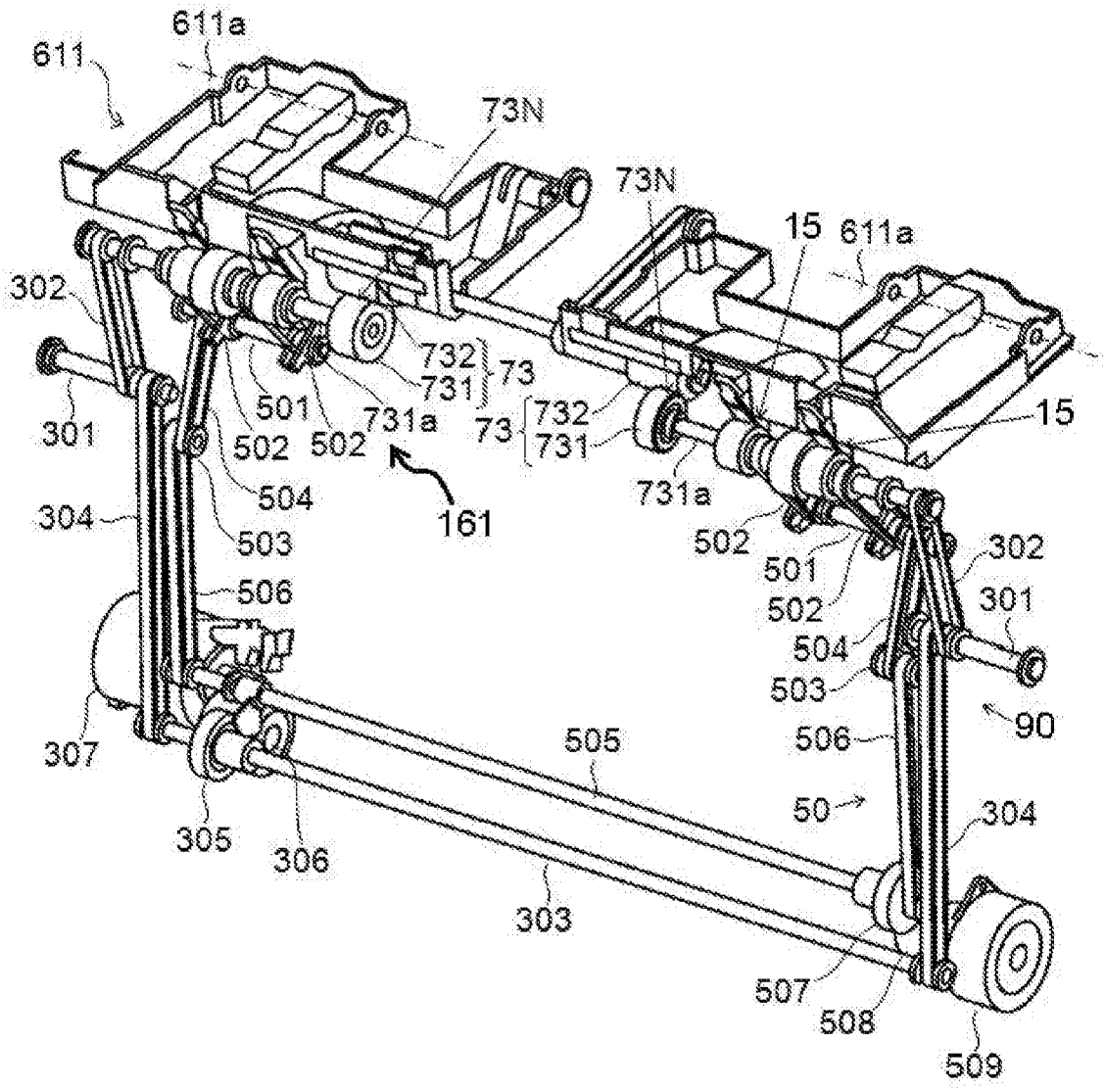
FIG. 6 is a perspective view showing a structure of a discharge drive portion and a paddle drive portion in the sheet loading device of the present embodiment.

FIG. 6 is a perspective view showing a configuration of the discharge drive portion 90 and a paddle drive portion 161 in the sheet loading device 10. The two second drive rollers 731 are simultaneously driven to rotate by the discharge drive portion 90. The discharge drive portion 90, as shown in FIG. 6, includes a drive transmission shaft 301, a first drive transmission belt 302, a drive shaft 303, a second drive transmission belt 304, a drive transmission gear 305, a drive gear 306, and a drive motor 307.

Two drive transmission shafts 301, two first drive transmission belts 302, and two second drive transmission belts 304 are provided corresponding to the two rotation shafts 731*a* of the two second drive rollers 731. One drive shaft 303, one drive transmission gear 305, one drive gear 306, and one drive motor 307 are provided.

The drive transmission shaft 301 is arranged below the rotation shaft 731*a* of the second drive roller 731. The drive transmission shaft 301 extends along the sheet width direction.

The first drive transmission belt 302 is wound around the rotation shaft 731*a* of the second drive roller 731 and the drive transmission shaft 301 via pulleys. The first drive transmission belt 302 transmits a rotational force of the drive transmission shaft 301 to the rotation shaft 731*a*.

The drive shaft 303 is arranged below the drive transmission shaft 301. The drive shaft 303 extends along the sheet width direction.

The second drive transmission belt 304 is wound around the drive transmission shaft 301 and the drive shaft 303 via pulleys. In detail, the two second drive transmission belts 304 are wound around the one drive shaft 303, and are respectively wound around the separate drive transmission shafts 301. The second drive transmission belts 304 transmit a rotational force of the drive shaft 303 to the drive transmission shafts 301.

The drive transmission gear 305 is provided on the drive shaft 303. The drive transmission gear 305 is arranged coaxially with the drive shaft 303, and rotates together with the drive shaft 303.

The drive gear 306 is provided on a rotation shaft of the drive motor 307. The drive gear 306 is rotated by the drive motor 307. The drive gear 306 meshes with the drive transmission gear 305.

In the discharge drive portion 90, when the drive motor 307 rotates, a rotational force of the drive motor 307 is transmitted via the drive gear 306 and the drive transmission gear 305 to the drive shaft 303, so that the drive shaft 303 rotates. When the drive shaft 303 rotates, the rotational force is transmitted via the second drive transmission belt 304 to the drive transmission shaft 301. When the drive transmission shaft 301 rotates, the rotational force is transmitted via the first drive transmission belt 302 to the rotation shaft 731*a* of the second drive roller 731. Thereby, the two second drive rollers 731 are simultaneously driven to rotate. The rotation of the second drive rollers 731, in other words, the operation of the discharge drive portion 90, is controlled by the post-processing control portion 100.

The four paddle members 15 are simultaneously driven to rotate by the paddle drive portion 161. The paddle drive portion 161, as shown in FIG. 6, includes a first drive transmission shaft 501, a first drive transmission belt 502, a second drive transmission shaft 503, a second drive transmission belt 504, a drive shaft 505, a third drive transmission belt 506, a drive transmission gear 507, a drive gear 508, and a drive motor 509.

Four first drive transmission belts 502 are provided corresponding to the four paddle members 15. Two first drive transmission shafts 501, two second drive transmission shafts 503, two second drive transmission belts 504, and two third drive transmission belts 506 are provided corresponding to the two rotation shafts 731*a* of the two second drive rollers 731. One drive shaft 505, one drive transmission gear 507, one drive gear 508, and one drive motor 509 are provided.

Figure 7:
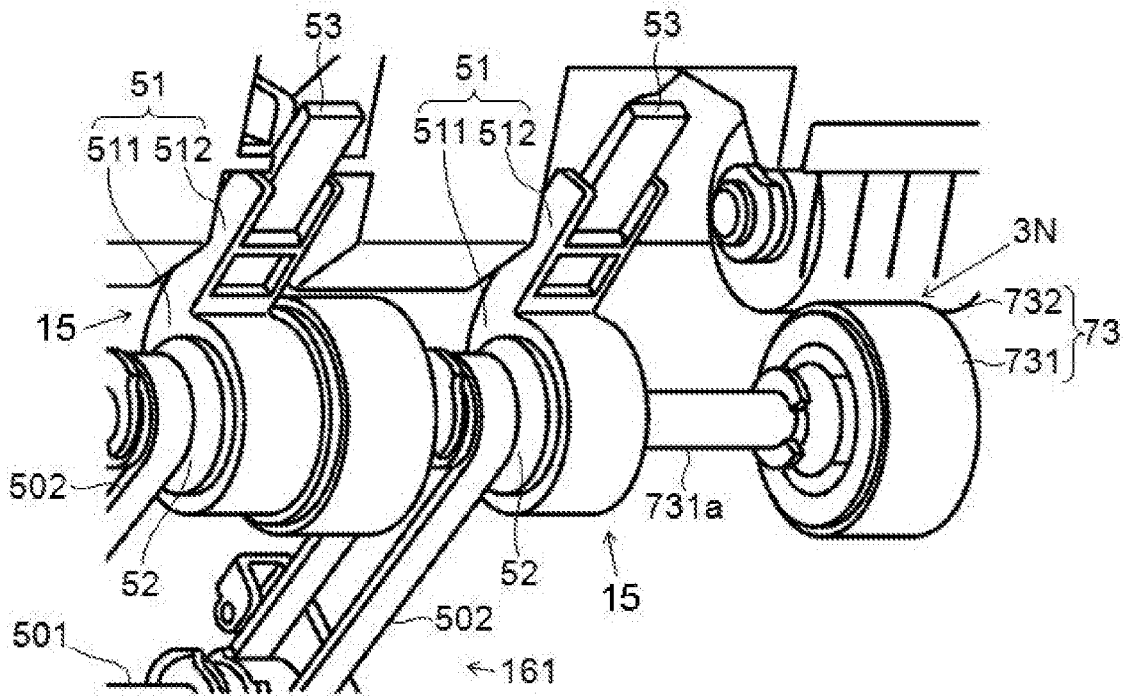
FIG. 7 is a partial perspective view of and around a discharge roller pair in the sheet loading device of the present embodiment.

The paddle members 15, as shown in FIG. 7, each include a paddle main body portion 51 and a shaft portion 52. The shaft portion 52 is fixed to a side of the paddle main body portion 51 in the sheet width direction. The paddle main body portion 51 and the shaft portion 52 are configured in cylindrical shapes of which central axes extend in the sheet width direction and arranged coaxially with an axis of the rotation shaft 731*a*. The paddle main body portion 51 has a smaller diameter than the second drive roller 731. The shaft portion 52 has a smaller diameter than the paddle main body portion 51. The rotation shaft 731*a* penetrates, in the sheet width direction, center parts of the paddle main body portion 51 and the shaft portion 52 in a diameter direction. The paddle main body portion 51 and the shaft portion 52 are rotatable independently of the rotation shaft 731*a*.

The first drive transmission shaft 501 is arranged below the rotation shaft 731*a* of the second drive roller 731. The first drive transmission shaft 501 extends along the sheet width direction.

The first drive transmission belt 502 is wound around the shaft portion 52 of the paddle member 15 and the first drive transmission shaft 501 via pulleys. In detail, the two first drive transmission belts 502 are wound around the one first drive transmission shaft 501, and are respectively wound around the shaft portions 52 of the separate paddle members 15. The first drive transmission belts 502 transmit a rotational force of the first drive transmission shaft 501 to the shaft portions 52 of the paddle members 15.

The second drive transmission shaft 503 is arranged below the first drive transmission shaft 501. The second drive transmission shaft 503 extends along the sheet width direction.

The second drive transmission belt 504 is wound around the first drive transmission shaft 501 and the second drive transmission shaft 503 via pulleys. The second drive transmission belt 504 transmits a rotational force of the second drive transmission shaft 503 to the first drive transmission shaft 501.

The drive shaft 505 is arranged below the second drive transmission shaft 503. The drive shaft 505 extends along the sheet width direction.

The third drive transmission belt 506 is wound around the second drive transmission shaft 503 and the drive shaft 505 via pulleys. In detail, the two third drive transmission belts 506 are wound around the one drive shaft 505, and are respectively wound around the separate second drive transmission shafts 503. The third drive transmission belts 506 transmit a rotational force of the drive shaft 505 to the second drive transmission shafts 503.

The drive transmission gear 507 is provided on the drive shaft 505. The drive transmission gear 507 is arranged coaxially with the drive shaft 505, and rotates together with the drive shaft 505.

The drive gear 508 is provided on a rotation shaft of the drive motor 509. The drive gear 508 is rotated by the drive motor 509. The drive gear 508 meshes with the drive transmission gear 507.

In the paddle drive portion 161, when the drive motor 509 rotates, a rotational force of the drive motor 509 is transmitted via the drive gear 508 and the drive transmission gear 507 to the drive shaft 505, so that the drive shaft 505 rotates. When the drive shaft 505 rotates, the rotational force is transmitted via the third drive transmission belt 506 to the second drive transmission shaft 503. When the second drive transmission shaft 503 rotates, the rotational force is transmitted via the second drive transmission belt 504 to the first drive transmission shaft 501. When the first drive transmission shaft 501 rotates, the rotational force is transmitted via the first drive transmission belt 502 to the shaft portion 52 of the paddle member 15. With this arrangement, the four paddle members 15 are driven to rotate simultaneously and are rotatable about the rotation shaft 731*a* of the second drive roller 731 independently of the second drive roller 731. The rotation of the paddle members 15, in other words, the operation of the paddle drive portion 161, is controlled by the post-processing control portion 100.

The paddle member 15, as shown in FIG. 7, includes the paddle main body portion 51 and a paddle elastic portion 53. The paddle main body portion 51 includes a base portion 511 which has formed therein a shaft hole and through which the rotation shaft 731*a* is inserted, and an arm portion 512 which is provided on an outer peripheral surface of the base portion 511.

The arm portion 512 projects in a direction that crosses the axis of the rotation shaft 731*a* of the base portion 511 and that is away from an axial center. In detail, the arm portion 512 projects from the outer peripheral surface of the base portion 511 outward substantially in a tangent direction of the outer peripheral surface. The arm portion 512 is integrally formed with the base portion 511. The arm portion 512 is made of a material that has a higher modulus of rigidity than a material of the paddle elastic portion 53.

The paddle elastic portion 53 projects longer than the arm portion 512 in a direction that crosses the axis of the rotation shaft 731*a* of the paddle main body portion 51 and that is away from the axial center. In detail, the paddle elastic portion 53 is attached to the arm portion 512, and projects longer than the arm portion 512 in the same direction as the arm portion 512. The paddle elastic portion 53 is configured of a material having a higher elasticity modulus than the arm portion 512 (the paddle main body portion 51), such as a rubber.

FIGS. 8 to 11 are diagrams for illustrating a sheet loading operation performed by the sheet loading device 10. A description will be given of an operation of the paddle member 15 in the sheet loading device 10, with reference to FIGS. 8 to 11.

Figure 8:
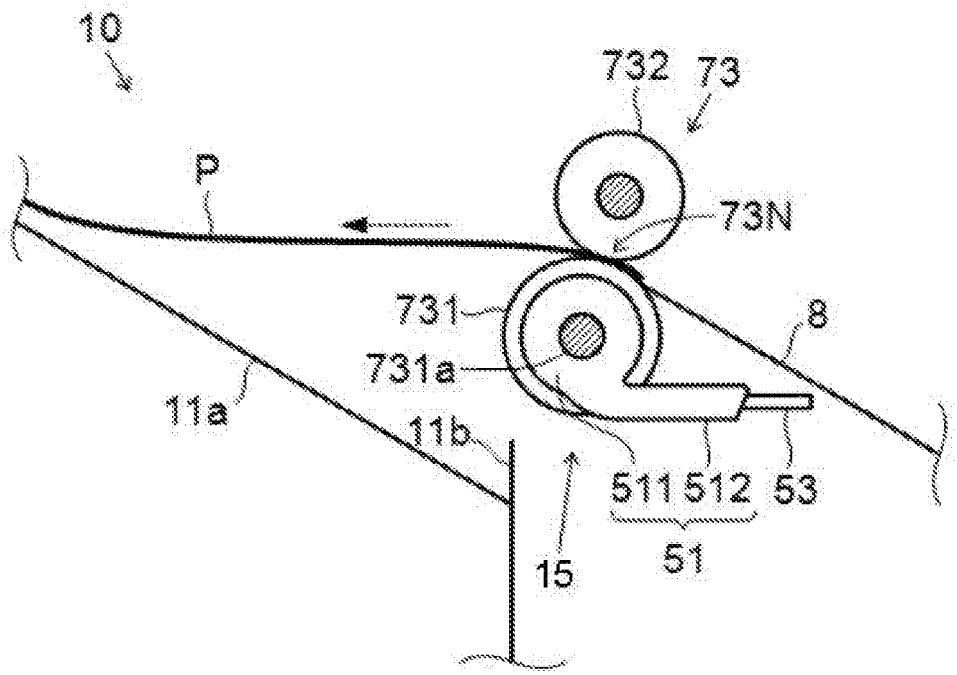
FIG. 8 is a diagram for illustrating a sheet loading operation performed by the sheet loading device of the present embodiment, showing a state in which a paddle member is located at a retraction position.

As shown in FIG. 8, the paddle member 15, before a start of its operation, is made to stop its rotation in a state of being arranged at a retraction position where the arm portion 512 and the paddle elastic portion 53 project neither toward the processing tray 8 nor toward the loading tray 11. That is, the paddle member 15 stands by at a predetermined position. With this arrangement, when out of use, the paddle member 15 does not interfere with discharging of a sheet P. A rotation speed of the discharge roller pair 73 is reduced by the time when the upstream end of the sheet P in the sheet discharge direction passes through the second nip portion 73N of the discharge roller pair 73. That is, a discharge speed of the sheet P to be discharged by the discharge roller pair 73 is reduced to a predetermined discharge speed by the time the upstream end of the sheet P in the sheet discharge direction passes through the second nip portion 73N of the discharge roller pair 73.

Figure 9:
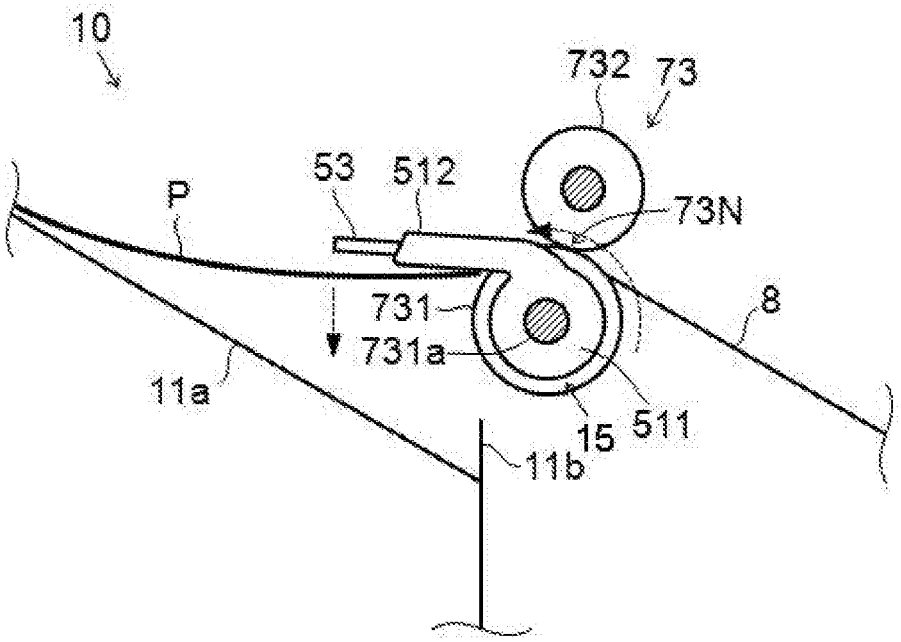
FIG. 9 is a diagram for illustrating the sheet loading operation performed by the sheet loading device of the present embodiment, showing a state in which the paddle member has started to rotate from the state in FIG. 8.

Next, as shown in FIG. 9, before the upstream end (rear end) of the sheet P in the sheet discharge direction passes through the second nip portion 73N of the discharge roller pair 73 to be loaded on the sheet loading surface 11*a* of the loading tray 11, the paddle drive portion 161 makes the paddle member 15 start rotating. A rotation speed of the paddle member 15 is equal to the rotation speed of the discharge roller pair 73 at which the discharge roller pair 73 rotates when the upstream end of the sheet P in the sheet discharge direction passes through its second nip portion 73N.

The paddle member 15 comes into contact with the upstream part (the rear end) of the sheet P in the discharge direction in which the sheet P is discharged by the discharge roller pair 73. Thereby, the paddle member 15 pushes down, toward the sheet loading surface 11*a*, the upstream part of the sheet P in the discharge direction, in which the sheet P has been discharged from the discharge roller pair 73, as if by slapping the upstream part from above.

Figure 10:
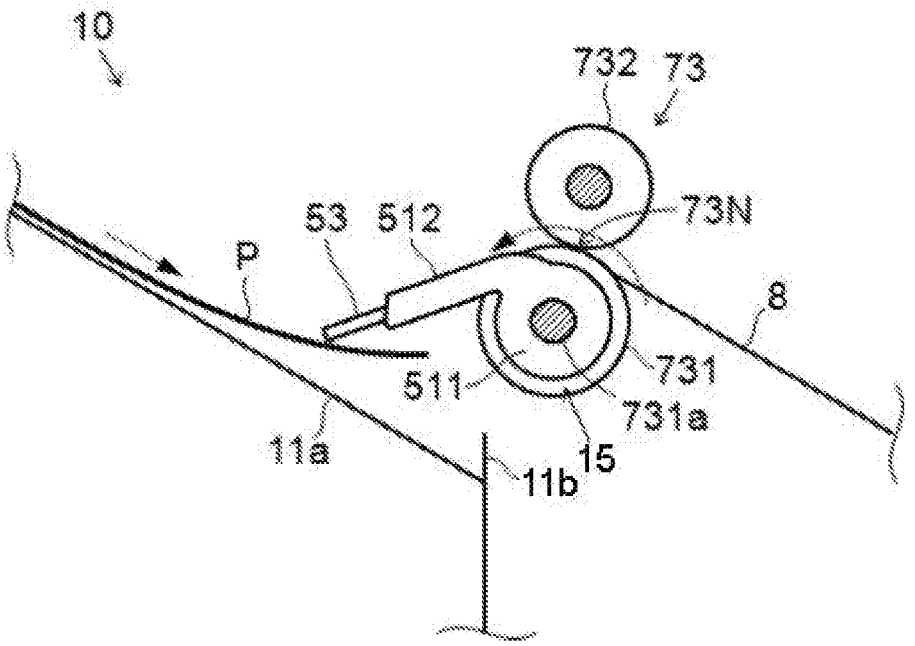
FIG. 10 is a diagram for illustrating the sheet loading operation performed by the sheet loading device of the present embodiment, showing a state in which the paddle member has rotated from the state in FIG. 9 into contact with an upstream part of a sheet in a discharge direction of the sheet.

When the paddle member 15 further rotates from the state shown in FIG. 9, the paddle elastic portion 53, as shown in FIG. 10, comes into contact with the upstream part of the discharged sheet P in the sheet discharge direction. Thereby, the paddle member 15 pulls the sheet P along the loading tray 11 toward the upstream side of the sheet P in the sheet discharge direction. Further, the paddle member 15 holds down the upstream part of the sheet P in the sheet discharge direction toward the sheet receiving wall 11*b* of the loading tray 11.

Figure 11:
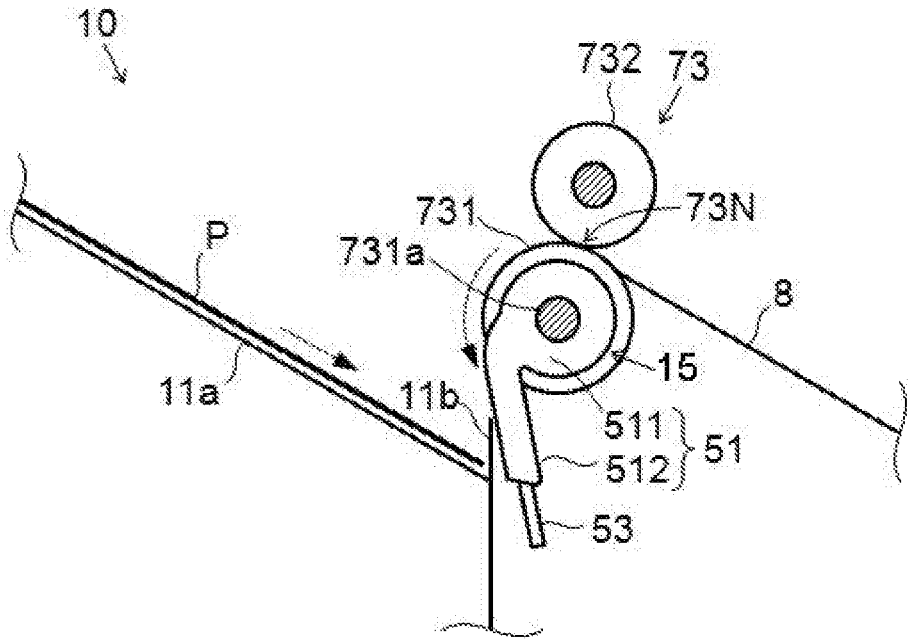
FIG. 11 is a diagram for illustrating the sheet loading operation performed by the sheet loading device of the present embodiment, showing a state in which the paddle member rotates from the state in FIG. 10 toward the retraction position.

Then, when the sheet loading operation by the sheet loading device 10 is completed, as shown in FIG. 11, the upstream part of the sheet P in the sheet discharge direction comes in contact with the sheet receiving wall 11*b* provided on the upstream side of the loading tray 11 in the sheet discharge direction. Thereby, the sheet P is aligned at a predetermined position on the loading tray 11. Here, the sheet receiving wall 11*b* has, on a rotational orbit of the paddle member 15, an unillustrated slit portion through which the paddle member 15 can pass. In this manner, the arm portion 512 and the paddle elastic portion 53 reach the retraction position at which they do no project toward the loading tray 11.

Figure 12:
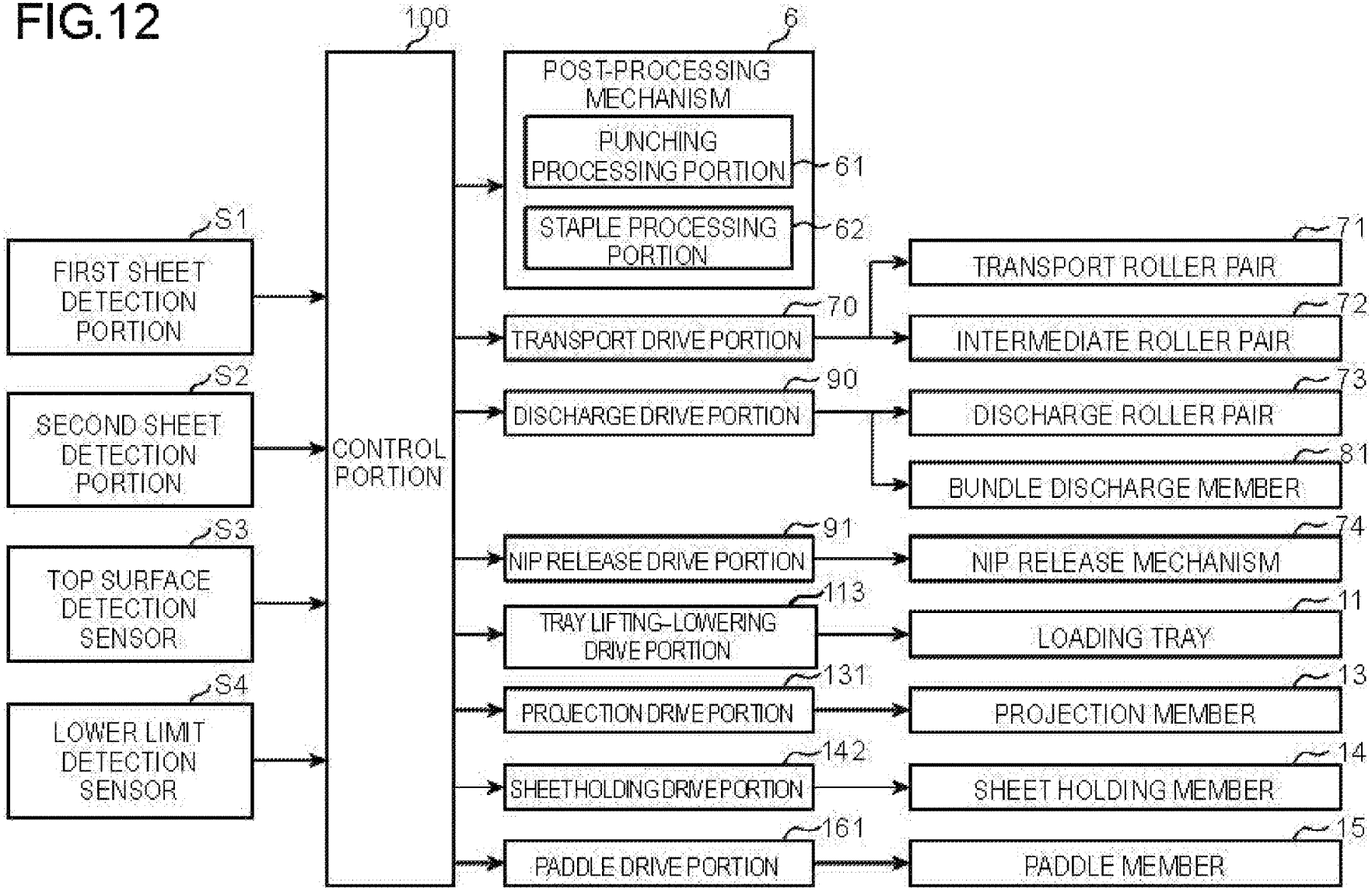
FIG. 12 is a block diagram showing an example of control paths in the sheet post-processing device.

FIG. 12 is a block diagram showing an example of a control path for the sheet post-processing device 5. The post-processing control portion 100 (hereinafter referred to simply as the control portion 100) is constituted by a CPU (Central Processing Unit) which controls operations of various portions of the sheet post-processing device 5 including the sheet loading device 10, a ROM (Read Only Memory) which stores a control program therein, a RAM (Random Access Memory) which is used as an operation area for the CPU, etc. The control portion 100 controls the operations of the various portions of the sheet post-processing device 5 including the sheet loading device 10 by the CPU executing the control program stored in the ROM.

The control portion 100 controls a punching processing operation performed by the punching processing portion 61 of the post-processing mechanism 6 and a staple processing operation performed by the staple processing portion 62 of the post-processing mechanism 6. The control portion 100 controls driving of the transport drive portion 70, and thereby controls rotating and stopping of the transport roller pair 71 and the intermediate roller pair 72. The control portion 100 controls driving of the discharge drive portion 90, and thereby controls rotating and stopping of the discharge roller pair 73 or reciprocating movement of the bundle discharge member 81.

The control portion 100 controls driving of a nip release drive portion 91, and thereby controls operations of releasing and recovering the second nip portion 73N of the discharge roller pair 73 performed by the nip release mechanism 74. For example, in a case where the staple processing is performed by the staple processing portion 62 with respect to a sheet bundle of a predetermined number of sheets, the control portion 100, after a first sheet is pulled into the processing tray 8, makes the nip release drive portion 91 drive the nip release mechanism 74 to release the second nip portion 73N. Then, after a second and subsequent sheets are pulled into the processing tray 8 and the staple processing is performed, the second nip portion 73N is recovered to discharge the sheet bundle onto the loading tray 11.

Here, in a case of discharging a sheet bundle onto the loading tray 11 by means of the bundle discharge member 81, with the second nip portion 73N released, the bundle discharge member 81 is moved to the downstream side in the sheet discharge direction, and the sheet bundle is pushed out and discharged onto the loading tray 11.

The control portion 100 controls driving of the tray lifting-lowering drive portion 113, and thereby controls the operation of lifting-lowering the loading tray 11. The control portion 100 controls driving of the projection drive portion 131, and thereby controls movement of the projection member 13 between a projection position and a retraction position along the guide rail 801. The control portion 100 controls driving of the sheet holding drive portion 142, and thereby controls a swinging operation which the sheet holding member 14 performs, by rotating about the swing shaft 14*a*, to swing between the sheet-holding position and the retraction position.

The control portion 100 controls driving of the paddle drive portion 161, and thereby controls a slapping operation which the paddle member 15 performs, by rotating about the rotation shaft 731*a*, to slap, toward the loading tray 11, a rear end of a sheet having passed through the discharge roller pair 73, and a holding operation which the paddle member 15 performs subsequently to the slapping operation to come into contact, from above, with the rear end part of the sheet having fallen into the loading tray 11 to hold the sheet down while pulling the sheet toward the upstream side.

Here, in a case of performing the above-described operation of lifting-lowering (positioning) the loading tray 11 in a mode in which sheets are loaded continuously one by one on the loading tray 11, in order to prevent the top surface detection sensor S3 from erroneously detecting a falling sheet or a curled rear end part of a sheet, the loading tray 11 is lifted and lowered with the sheet holding member 14 holding the sheets. At this time, depending on whether the lifting-lowering operation is finished with the top surface detection sensor S3 in an on state or the lifting-lowering operation is finished with the top surface detection sensor S3 in an off state, the following inconvenience may occur.

For example, control may be performed in such a manner that the top surface detection sensor S3 is confirmed to be on and then a top surface of sheets is detected, the loading tray 11 is once lowered and then the top surface detection sensor S3 is confirmed to be off, and then the loading tray 11 is lifted again and the lifting-lowering operation is finished with the top surface detection sensor S3 in the on state. In this case, the top surface of the sheets is located nearest the rotational orbit of the paddle member 15.

The paddle member 15 has a role of pushing down a sheet toward the sheet loading surface 11*a* of the loading tray 11 as if by slapping a rear end of the sheet from above, pulling the sheet along the loading tray 11 toward the upstream side in the sheet discharge direction, and holding down an upstream part of the sheet in the sheet discharge direction toward the sheet receiving wall 11*b* of the loading tray 11, and thus it is preferable for the paddle member 15 to have a possible maximum paddle length.

Thus, if the lifting-lowering operation is finished with the top surface detection sensor S3 in the on state, the top surface of the sheets loaded by a next lifting-lowering operation may overlap with the orbit of the paddle member 15 and make the paddle member 15 unrotatable (locked).

On the other hand, in a case where the lifting-lowering operation is finished with the top surface detection sensor S3 in the off state in order to avoid the risk of the paddle member 15 coming near the top surface of the sheets, if the sheets having been loaded during continuous sheet discharge are removed, the loading tray 11 does not rise to a predetermined position in the next lifting-lowering operation. As a result, a height difference between the discharge roller pair 73 and the top surface of the sheets is increased, and this may invite an unstable sheet discharge state in which, for example, a leading end of a sheet discharged by the discharge roller pair 73 is curled or a sheet is reversed, and cause poor alignment of sheets loaded on the loading tray 11.

To prevent this, in the present embodiment, first the loading tray 11 is lowered and the top surface detection sensor S3 is confirmed to be off, then the loading tray 11 is once lifted and the top surface detection sensor S3 is confirmed to be on, and after the top surface of the sheets is detected, the loading tray 11 is lowered again and the lifting-lowering operation is finished with the top surface detection sensor S3 in the off state.

Figure 13:
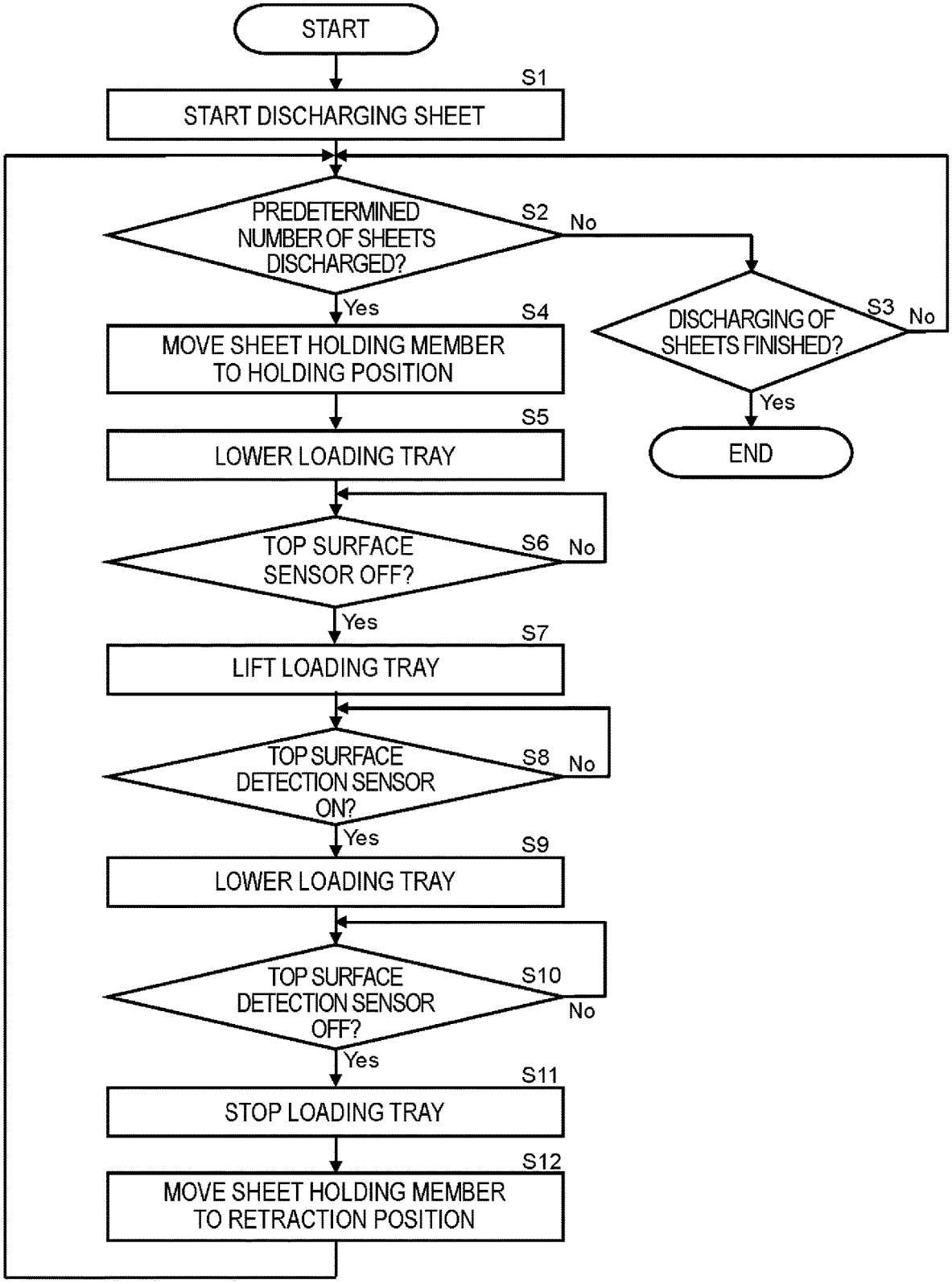
FIG. 13 is a flowchart showing an example of control in a lifting-lowering operation of a loading tray performed in the sheet loading device of the present embodiment.

FIG. 13 is a flowchart showing an example of control of the lifting-lowering operation of lifting and lowering the loading tray 11 performed in the sheet loading device 10 of the present embodiment. With reference to FIGS. 1 to 12 and later-described FIGS. 14 and 15, as necessary, along the steps shown in FIG. 13, a description will be given of a method of positioning the loading tray 11 of the sheet loading device 10 at a reference position (home position).

First, the sheet post-processing device 5 is in a mode (one-by-one mode) in which it processes sheets continuously one by one, and the loading tray 11 of the sheet loading device 10 is arranged at the reference position.

When discharging of sheets onto the loading tray 11 is started from this state (step S1), the control portion 100 determines whether or not a predetermined number (here, ten) sheets have been discharged (step S2). If the predetermined number has not been reached (No in step S2), the control portion 100 determines whether or not the discharging of sheets has been finished (step S3). If the discharging of sheets has not been finished (No in step S3), the flow returns to step S2, and the discharging of sheets is continued. When the discharging of sheets has been finished (Yes in step S3), the processing is finished.

In a case where the predetermined number of sheets have been discharged (Yes in step S2), the sheet holding member 14 is moved from the retraction position to the sheet-holding position (step S4). Then, the loading tray 11 is lowered (step S5).

Next, the control portion 100 determines whether or not the top surface detection sensor S3 has been turned off (step S6). In a case where the top surface detection sensor S3 is on (No in step S6), the loading tray 11 continues to be lowered.

FIG. 14 is a side sectional view of the sheet loading device 10, showing a state in which the top surface detection sensor S3 is off. In FIG. 14, the loading tray 11 has descended to a position at which a topmost sheet P1U of sheets P1 loaded on the sheet loading surface 11*a* does not overlap with a detection portion S3*a* of the top surface detection sensor S3. In a case where the top surface detection sensor S3 has been turned off as shown in FIG. 14 (Yes in step S6), the loading tray 11 is lifted (step S7).

Next, the control portion 100 determines whether or not the top surface detection sensor S3 has been turned on (step S8). In a case where the top surface detection sensor S3 is off (No in step S8), the loading tray 11 continues to be lifted.

Figure 15:
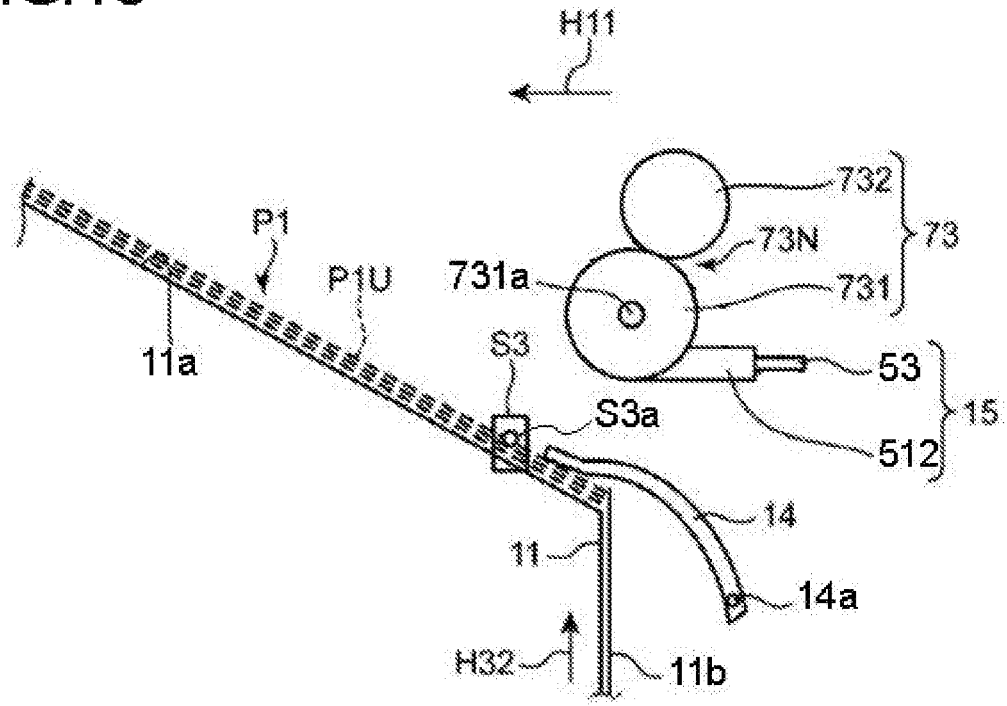

FIG. 15 is a side sectional view of the sheet loading device 10, showing a state in which the top surface detection sensor S3 is on. In FIG. 15, the loading tray 11 has ascended to a position at which the topmost sheet P1U of the sheets P1 loaded on the sheet loading surface 11*a* overlaps with the detection portion S3*a* of the top surface detection sensor S3. In a case where the top surface detection sensor S3 has been turned on as shown in FIG. 15 (Yes in step S8), the loading tray 11 is lowered again (step S9).

Next, the control portion 100 determines whether or not the top surface detection sensor S3 has been turned off (step S10) In a case where the top surface detection sensor S3 is on (No in step S10), the loading tray 11 continues to be lowered. In a case where the top surface detection sensor S3 has been turned off as shown in FIG. 14 (Yes in step S10), the loading tray 11 is stopped (step S11). This position is the reference position of the loading tray 11. Thereafter, the sheet holding member 14 is moved to the retraction position (step S12) and the flow returns to step S2, and the similar processing is repeated.

According to the above-described control example, after the state of the top surface detection sensor S3 changes from off to on to off, the operation of lifting-lowering the loading tray 11 is finished and the loading tray 11 is positioned at the reference position. Thus, as compared with a case where the lifting-lowering operation is finished with the top surface detection sensor S3 on, the clearance between the rotational orbit of the paddle member 15 and the top surface of the sheets can constantly be widened by a certain distance. Accordingly, it is possible to achieve as long a paddle length of the paddle member 15 as possible while avoiding inconveniences such as the paddle member 15 becoming unable to rotate (locked state) and unstable sheet discharge state occurring when loaded sheets are removed.

Further, since the topmost sheet surface is detected after the sheet holding member 14 is moved to the sheet-holding position, it is possible to prevent erroneous detection by the top surface detection sensor S3 due to a lifted or curled rear end of a sheet.

Figure 16:
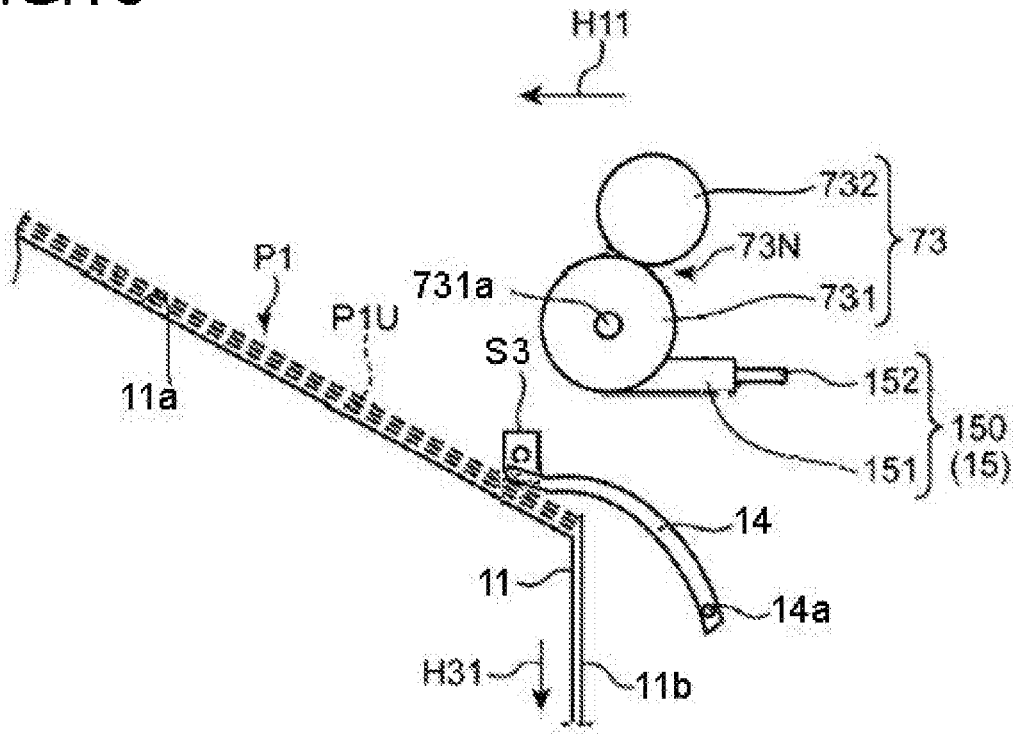
FIG. 16 is a side sectional view of the sheet loading device where the top surface detection sensor is arranged at a position overlapping with a leading end of a sheet holding member arranged at a holding position, showing a state in which the upper surface detection sensor is off.
Figure 17:
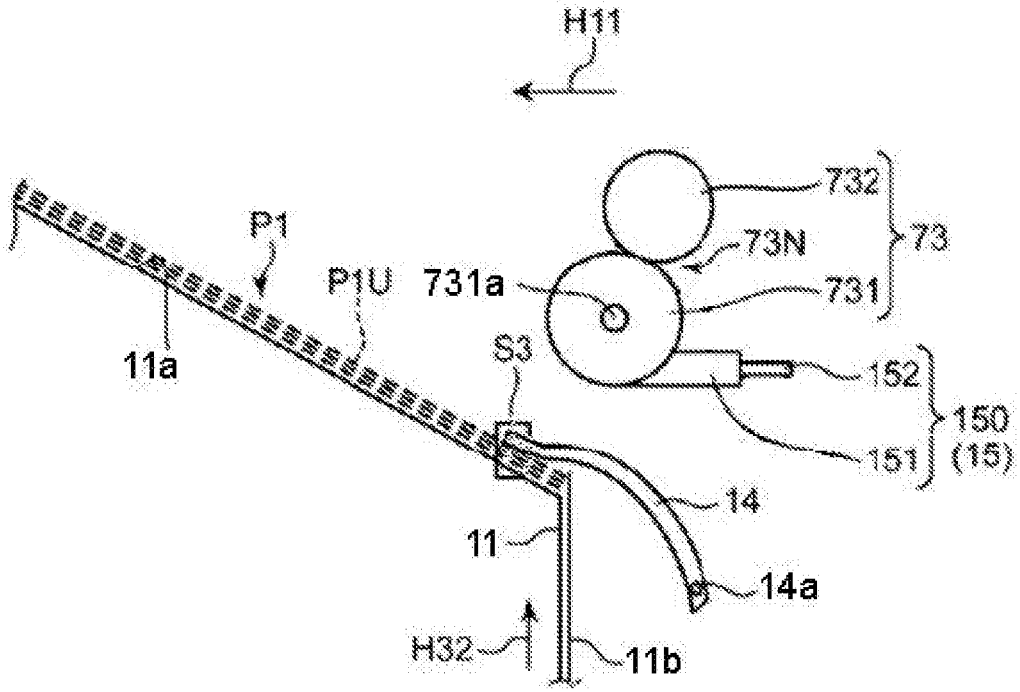

Furthermore, as shown in FIGS. 16 and 17, by arranging the top surface detection sensor S3 at a position at which the top surface detection sensor S3 overlaps with the leading end of the sheet holding member 14 arranged at the sheet-holding position, the sheet holding member 14 can be detected by the top surface detection sensor S3 when detecting a position of the top surface of the sheets.

According to this configuration, whether the top surface detection sensor S3 is in the off state as shown in FIG. 16 or in the on state as shown in FIG. 17, an actual position of the top surface is lower, by a thickness of the sheet holding member 14, than in a case where the topmost sheet P1U is detected as shown in FIGS. 14 and 15. As a result, the clearance between the rotational orbit of the paddle member 15 and the top surface of the sheets can be widened to provide a sufficient margin for the paddle member 15 to rotate. Accordingly, it is possible to dealt also with cases where discharged sheets have different thicknesses and where a rear end of a sheet is curled.

Here, in a case where the flag 11*e* (see FIG. 2) stops slightly before the lower limit detection sensor S4 is turned on when the operation of lifting-lowering the loading tray 11 is finished, in a next lifting-lowering operation, it is detected that the loading tray 11 has reached the lower limit position. In this case, the loading tray 11 can hardly descend in the next lifting-lowering operation, and thus, after the next lifting-lowering operation is finished, the position of the top surface of sheets loaded after the next lifting-lowering operation is finished comes above a detection position (upper limit position) of the top surface detection sensor S3, and thus it becomes impossible for the paddle member 15 to rotate (locked state).

Figure 18:
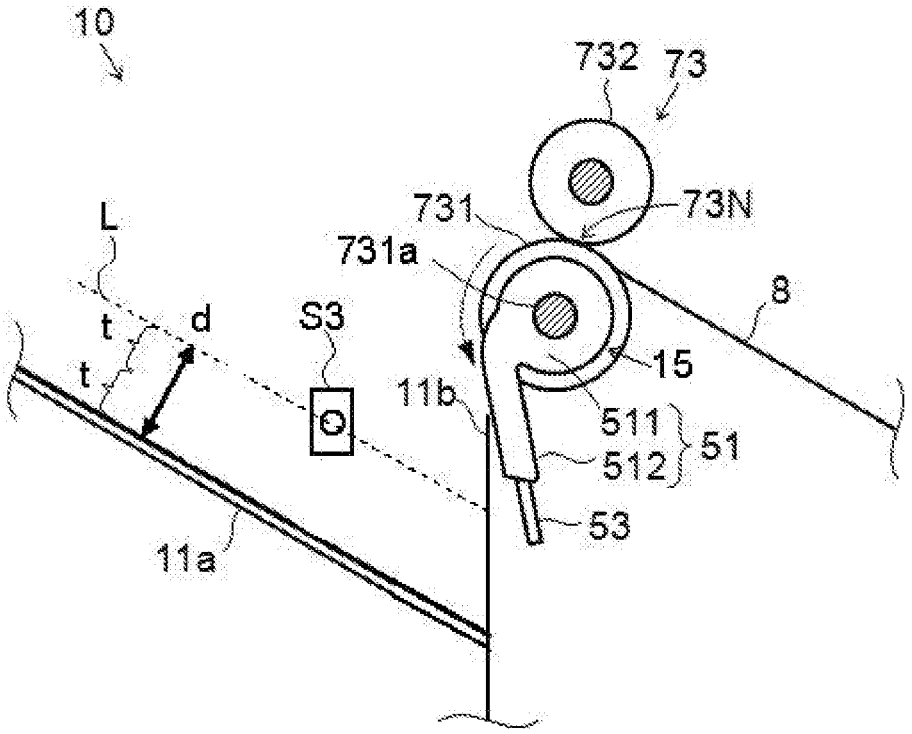
FIG. 18 is a side view of and around the discharge roller pair, showing a state in which the loading tray has descended to a reference position, the loading tray having descended by a descent distance twice as long as the thickness of a sheet bundle of a maximum number of sheets.

FIG. 18 is a side view of and around the discharge roller pair 73, showing a state in which the loading tray 11 has descended to the reference position in the sheet loading device 10 of the present embodiment. As shown in FIG. 18, when the lifting-lowering operation is finished and the loading tray 11 is positioned at the reference position after the state of the top surface detection sensor S3 changes from off to on to off, when a descending amount (descending distance) of atop surface of sheets from the detection position (indicated by a broken line L in FIG. 18) of the top surface detection sensor S3 is represented by "d", and a thickness of a sheet bundle of a maximum number of sheets (for example, 100 sheets) dischargeable from the processing tray 8 onto the loading tray 11 at one time is represented by "t", formula (1) below is satisfied:

$$d>2\times t \tag{1}$$

According to this configuration, a secured amount of sheets loadable on the sheet loading surface 11*a* in one event of the operation of lifting-lowering the loading tray 11 exceeds twice the maximum number of sheets in one sheet bundle. Thus, even when the loading tray 11 reaches the lower limit position in the next lifting-lowering operation and the loading tray 11 hardly descends, a sheet bundle of the maximum number of sheets can be loaded on the sheet loading surface 11*a* of the loading tray 11. Accordingly, even when the loading tray 11 reaches the lower limit position, the position of the top surface of the sheets does not exceed the detection position (upper limit position) of the top surface detection sensor S3, and thus it is possible to prevent the inconvenience of the paddle member 15 becoming unable to rotate (locked state).

In the configuration shown in FIG. 18, when the lower limit detection sensor S4 detects that the loading tray 11 has reached the lower limit position, the discharging operation thereafter is stopped. Thus, in a case where a sheet bundle discharged when the loading tray reaches the lower limit position includes only a small number of sheets, the discharging operation is stopped with a margin left in the number of sheets loadable on the sheet loading surface 11*a* of the loading tray 11, and this may result in degraded loading efficiency (post-processing efficiency).

To prevent this, when the lower limit detection sensor S4 is turned into the on state, a judgment is made whether or not to stop the sheet discharging operation in accordance with the number of sheets in a next sheet bundle to be discharged. This helps prevent the inconvenience of the paddle member 15 becoming unable to rotate (locked state) with as little degradation of the loading efficiency as possible.

Figure 19:
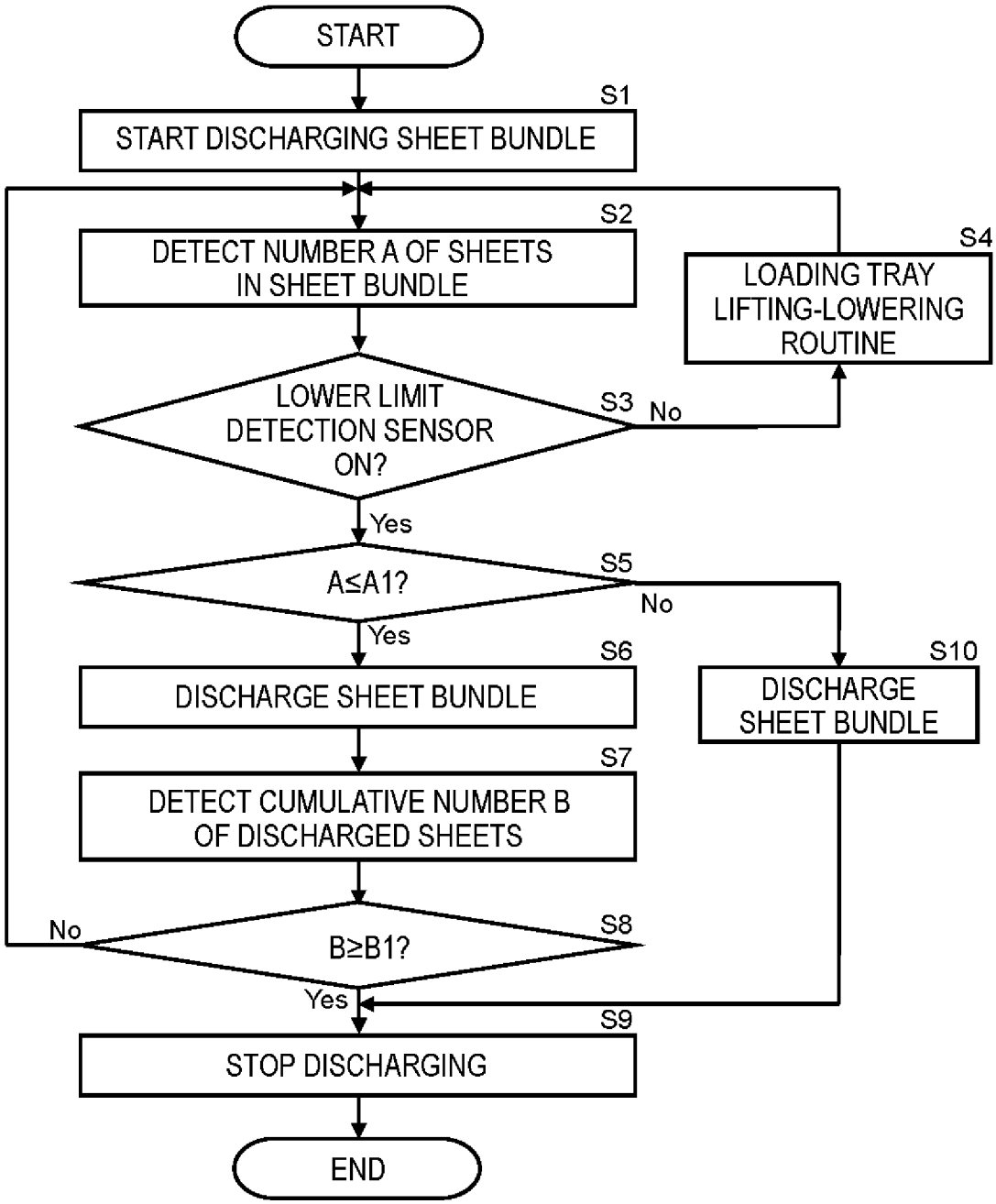
FIG. 19 is a flowchart showing an example of control in a discharging operation performed when a lower limit position of the loading tray has been detected by a lower limit detection sensor.

FIG. 19 is a flowchart showing an example of control in the discharging operation performed when the lower limit position of the loading tray 11 has been detected by the lower limit detection sensor S4. By referring to FIGS. 1 to 18 as necessary, along the steps shown in FIG. 19, a description will be given of the discharging operation performed when the lower limit position of the loading tray 11 has been detected.

First, the sheet post-processing device 5 is set in a mode (bundle processing mode) in which the staple processing is performed with respect to a sheet bundle loaded on the processing tray 8, and the loading tray 11 of the sheet loading device 10 is arranged at the reference position.

When, from this state, discharging of a sheet bundle onto the loading tray 11 is started (step S1), the control portion 100 detects a number A of sheets in the sheet bundle (step S2). The number of sheets in the sheet bundle can be detected by, for example, counting the number of sheets that pass the first sheet detection portion S1 (or the second sheet detection portion S2).

Next, the control portion 100 determines whether or not the lower limit detection sensor S4 is on (step S3). In a case where the lower limit detection sensor S4 is not in the on state (No in step S3), the loading tray 11 has not reached the lower limit position, and thus the flow proceeds to a loading-tray lifting-lowering routine shown in FIG. 13 (step S4). Specifically, each time a sheet bundle of a predetermined number of sheets is discharged, the loading tray 11 is lifted and lowered, and after the state of the top surface detection sensor S3 changes from off to on to off, the lifting-lowering operation is finished, and the loading tray 11 is positioned at the reference position. The reference position is below the detection position (upper limit position) of the top surface detection sensor S3 by a distance equal to twice the thickness of the maximum number of sheets (for example, 100 sheets) discharged onto the loading tray 11.

In a case where the lower limit detection sensor S4 is in the on state (Yes in step S3), it is determined whether or not the number A of sheets included in the discharged sheet bundle is equal to or larger than a predetermined number A1 (for example, 50) (step S5). In a case where A≤A1 (Yes in step S5), the sheet bundle is discharged (step S6). Also, a cumulative number B of sheets having been discharged after the lower limit detection sensor S4 is turned into the on state is detected (step S7).

Next, the control portion 100 determines whether or not the cumulative number B of the discharged sheets is equal to or larger than a predetermined number B1 (step S8). The predetermined number B1 is set to be smaller than the maximum number of sheets loadable when the loading tray 11 is at the reference position (twice as large as the maximum number of sheets in a sheet bundle). For example, in a case where the maximum number of sheets in a sheet bundle is 100, the predetermined number B1 is set to a number (for example, B1=150) that is smaller than 200 (=100×2).

In a case where B<B1 (No in step S8), there is a margin in the number of sheets loadable on the loading tray 11, the flow returns to step S2, where discharging of sheets onto the loading tray 11 is continued (steps S2 to S8). In a case where B≥B1 (Yes in step S8), there is no margin left in the number of sheets loadable on the loading tray 11, and thus the discharging of sheets onto the loading tray 11 is stopped (step S9).

On the other hand, in a case where A>A1 in step S5 (No in step S5), it is determined that the discharging of a sheet bundle this time will leave no margin in the number of loadable sheets, and after the sheet bundle is discharged (step S10), the discharging operation is stopped (step S9).

According to the control described above, in a case where it is detected that the loading tray 11 is at the lower limit position, when the number of sheets in a discharged sheet bundle is small, the discharging of a sheet bundle is continued. Thus, the discharging operation is never stopped with a margin left in the number of loadable sheets, and this helps reduce degradation of processing efficiency.

On the other hand, when the discharged sheet bundle is of a large number of sheets, discharging of a sheet bundle thereafter is stopped, and this helps prevent inconvenience such that the paddle member 15 becomes unable to rotate because the loading tray 11 does not descend. The threshold values A1 and B1 can be appropriately set in accordance with the maximum number of sheets in a sheet bundle dischargeable in one event of sheet discharge.

The present disclosure is not limited to the embodiments described above and various modifications thereto can be made without departing from the spirit and scope of the present disclosure. For example, in the embodiments described above, the projection member 13 is displaced between the projection position at which a sheet discharged by the discharge roller pair 73 comes into contact with the top surface of the projection member 13 and the retraction position at which the projection member 13 is retracted to the upstream side in the sheet discharge direction, but a configuration is possible without the projection member 13.

Further, in the embodiments described above, the image forming apparatus 200 in the image forming system S is a multifunction peripheral for monochrome printing, but this is not meant to limit the present disclosure. The image forming apparatus 200 may instead be, for example, a monochrome copier, a monochrome printer, or the like, or may instead be an image forming apparatus for color printing, such as a color copier, a color printer, or the like.

What is claimed is:

1. A sheet loading device comprising:

a discharge roller pair which includes a drive roller and a driven roller which follows the drive roller to rotate, and which discharges a sheet;

a loading tray which is arranged on a downstream side of the discharge roller pair with respect to a discharge direction of the sheet, and on which sheet discharged by the discharge roller pair is loaded;

a paddle member which is arranged coaxial with the drive roller, and which rotates in a same direction as the drive roller to thereby come into contact, from above, with an upstream part, in the discharge direction, of the sheet discharged by the discharge roller pair;

a sheet holding member which is arranged below the discharge roller pair, and which is swingable between a holding position at which the sheet holding member holds the upstream part, in the discharge direction, of the sheet loaded on the loading tray and a retraction position at which the sheet holding member releases holding of the sheet;

a tray lifting-lowering drive portion which lifts and lowers the loading tray;

a top surface detection sensor which switches between an on state in which the top surface detection sensor performs detection of a sheet loading surface of the loading tray or of a top surface of the sheet loaded on the sheet loading surface and an off state in which the top surface detection sensor does not perform the detection; and a control portion which controls the tray lifting-lowering drive portion, wherein the control portion which performs a lifting-lowering operation to arrange the loading tray at a reference position by lowering the loading tray with the sheet holding member arranged at the holding position to turn the top surface detection sensor into the off state, then lifting the loading tray to turn the top surface detection sensor into the on state, and then lowering the loading tray again to turn the top surface detection sensor into the off state and stopping the loading tray, and, with the loading tray at the reference position, a predetermined clearance is provided between the top surface of the sheet loaded on the loading tray and a rotational orbit of the paddle member.

2. The sheet loading device according to claim 1, wherein a swing orbit of a leading end of the sheet holding member overlaps with a detection portion of the top surface detection sensor, and the control portion, in performing the lifting-lowering operation, lifts the loading tray with the top surface detection sensor in the off state in which the top surface detection sensor detects the sheet holding member, turns the top surface detection sensor into the on state in which the top surface detection sensor detects the sheet holding member, and then lowers the loading tray again to turn the top surface detection sensor into the off state in which the top surface detection sensor does not detect the sheet holding member.

3. The sheet loading device according to claim 1, wherein when the top surface detection sensor is in the on state, the top surface of the sheet and the rotational orbit of the paddle member do not overlap with each other, and, when a descent amount by which the loading tray is lowered again after the top surface detection sensor is turned into the on state until the top surface detection sensor is turned into the off state and the loading tray is stopped is represented by d, the following formula (1) is satisfied:

$$d>2\times t \quad (1)$$

where t represents a thickness of a sheet bundle of a maximum number of sheets dischargeable onto the loading tray at a time.

4. The sheet loading device according to claim 3, further comprising:

a lower limit detection sensor which detects that the loading tray has reached a lower limit position, wherein when it is detected by the lower limit detection sensor that the loading tray has reached the lower limit position, in a case where a number A of sheets in the sheet bundle to be discharged onto the loading tray in next discharging is equal to or smaller than a predetermined number A1, the control portion continuously performs the next and subsequent discharging of the sheet bundle, and in a case where the number A of sheets in the sheet bundle is larger than the predetermined number A1, the control portion stops the next and the subsequent discharging of the sheet bundle.

5. The sheet loading device according to claim 4, wherein in a case where the number A of sheets in the sheet bundle is equal to or smaller than the predetermined number A1, the control portion detects a cumulative number B of sheets in the sheet bundle having been discharged onto the loading tray after the loading tray reaching the lower limit position, and in a case where the cumulative number B of discharged sheets is equal to or larger than a predetermined number B1, the control portion stops next and subsequent discharging of the sheet bundle.

6. The sheet loading device according to claim 1, wherein the paddle member includes a paddle main body portion having a base portion which has formed therein a shaft hole through which a rotation shaft is inserted, and an arm portion which projects from the base portion in a direction that crosses an axis of the rotation shaft and that is away from an axial center, and a paddle elastic portion which is attached to the arm portion, projects from the arm portion, and has a lower elasticity modulus than the paddle main body portion.

7. The sheet loading device according to claim 1, further comprising:

a projection member which projects in a direction that is toward a downstream side of the discharge roller pair with respect to the discharge direction but is upward of the loading tray, and which is displaced between a projection position at which the sheet discharged by the discharge roller pair contacts a top surface of the projection member and a retraction position at which the projection portion is retracted to an upstream side of the discharge roller pair.

8. A sheet post-processing device comprising:

a post-processing mechanism which performs predetermined post-processing with respect to the sheet; and the sheet loading device according to claim 1 which has the discharge roller pair arranged on a downstream side of the post-processing mechanism with respect to the discharge direction, and which has the sheet on which the post-processing has been performed by the post-processing mechanism loaded on the loading tray by the discharge roller pair.

9. An image forming system comprising:

the sheet post-processing device according to claim 8; and an image forming apparatus which is connected to the sheet post-processing device, forms an image on the sheet, and transports the sheet into the sheet post-processing device after forming the image on the sheet.

* * * * *